US008960516B2

(12) United States Patent
Iijima et al.

(10) Patent No.: US 8,960,516 B2
(45) Date of Patent: Feb. 24, 2015

(54) FASTENER DRIVING TOOL

(75) Inventors: Yoshimitsu Iijima, Hitachinaka (JP); Norikazu Baba, Hitachinaka (JP); Yasuki Ohmori, Hitachinaka (JP); Shouichi Hirai, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 449 days.

(21) Appl. No.: 13/390,399

(22) PCT Filed: Sep. 15, 2010

(86) PCT No.: PCT/JP2010/066462

§ 371 (c)(1),
(2), (4) Date: Feb. 14, 2012

(87) PCT Pub. No.: WO2011/040315

PCT Pub. Date: Apr. 7, 2011

(65) Prior Publication Data

US 2012/0181319 A1 Jul. 19, 2012

(30) Foreign Application Priority Data

Sep. 30, 2009 (JP) ..... 2009-226571
Jun. 14, 2010 (JP) ..... 2010-134840
Jun. 30, 2010 (JP) ..... 2010-148956

(51) Int. Cl.
*B25C 1/08* (2006.01)
*B25B 21/00* (2006.01)
(Continued)

(52) U.S. Cl.
CPC ... *B25C 1/08* (2013.01); *B25C 1/14* (2013.01); *B25B 21/00* (2013.01); *B25B 21/023* (2013.01); *B25B 27/0085* (2013.01)
USPC ..... 227/8; 227/10; 227/130; 227/132; 227/147

(58) Field of Classification Search
CPC ..... B25C 1/08; B25C 1/14; B25B 21/00; B25B 21/023; B25B 27/0085
USPC ..... 227/8, 10, 130, 132, 147
See application file for complete search history.

(56) References Cited

U.S. PATENT DOCUMENTS 3,552,627 A * 1/1971 Moreno ..... 227/121
3,589,588 A * 6/1971 Vasku ..... 227/132

(Continued)

FOREIGN PATENT DOCUMENTS

CN 1217967 A 6/1999
FR 1456570 10/1966

(Continued)

OTHER PUBLICATIONS

Office Action from China Intellectual Property Office for application 201080011991.3 (Jun. 5, 2013).

(Continued)

*Primary Examiner* — Michelle Lopez
(74) *Attorney, Agent, or Firm* — Kilpatrick Townsend & Stockton LLP

(57) ABSTRACT

A fastener driving tool is capable of not only linearly driving but also rotationally fastening a fastener into a workpiece P. The fastener driving tool includes a housing 2, a nose portion 40 formed with an injection passage 40*a* through which a fastener 41 is driven, a magazine 4 accommodating fasteners 41 and supplying a fastener 41 to the nose portion 40, a push lever 5 movable relative to the housing 2 upon depression against the workpiece P, combustion chamber frames 12, 22 movable in the housing 2 in accordance with the movement of the push lever 5, and first and second cylinders 7, 8 fixed to the housing 2. First and second pistons 71, 81 are movably disposed in the first and second cylinders 7,8, respectively, and a bit 9 extends from the first piston 71. A rod 14 formed with a rack 14A extends from the second piston 72. The rack 14A is engageable with a motion conversion mechanism 6 for converting a linear motion of the rod 14 into rotational motion of the bit 9.

18 Claims, 20 Drawing Sheets

(51) Int. Cl.

| | |
|---|---|
| ***B25C 1/14*** | (2006.01) |
| ***B25B 21/02*** | (2006.01) |
| ***B25B 27/00*** | (2006.01) |

(56) References Cited

U.S. PATENT DOCUMENTS

| | | | | |
|---|---|---|---|---|
| RE29,354 | E * | 8/1977 | Malkin | 227/132 |
| 4,215,808 | A * | 8/1980 | Sollberger et al. | 227/146 |
| 4,415,110 | A | 11/1983 | Hunter | |
| 5,592,580 | A | 1/1997 | Doherty et al. | |
| 5,720,423 | A * | 2/1998 | Kondo et al. | 227/130 |
| 5,909,836 | A | 6/1999 | Shkolnikov et al. | |
| 2006/0180631 | A1 * | 8/2006 | Pedicini et al. | 227/130 |

FOREIGN PATENT DOCUMENTS

| | | | |
|---|---|---|---|
| GB | 1187585 | | 4/1970 |
| GB | 1262073 | | 2/1972 |
| JP | 2005-271144 | A | 10/2005 |
| WO | WO2008/085465 | A2 | 7/2008 |

OTHER PUBLICATIONS

International Search Report for PCT application PCT/JP2010/066462 (Jan. 14, 2011).

Patentability Report for PCT application PCT/JP2010/066462 (Apr. 12, 2012).

Japan Patent Office office action for patent application JP2010-134840 (Feb. 3, 2014).

* cited by examiner

Va-Va

Vb-Vb

FASTENER DRIVING TOOL

CROSS REFERENCE TO RELATED APPLICATION

This application claims priority from Japanese Patent Application No. 2009-226571 filed Sep. 30, 2009, Japanese Patent Application No. 2010-134840 filed Jun. 14, 2010, and Japanese Patent Application No. 2010-148956 filed Jun. 30, 2010. The entire contents of each of these priority applications are incorporated herein by reference.

TECHNICAL FIELD

The present invention relates to a fastener driving tool that drives a faster such as a screw into a workpiece. The fastener driving tool provides a linear driving force in an axial direction of the fastener and also provides rotational driving force rotating about an axis of the fastener.

BACKGROUND ART

In a conventional combustion type fastener driving tool, combustion and explosion of air-fuel mixture in a combustion chamber generates driving force of a piston within a cylinder to drive a fastener into a workpiece.

CITATION LIST

Patent Literature

PLT1: Patent Application Publication No. WO2008/085465

PLT2: Japanese Patent No. 3651988

SUMMARY OF INVENTION

Technical Field

However, the conventional combustion type fastener driving tool is configured to drive a fastener such as a nail in its axial direction. No combustion type fastener driving tool has been proposed which provides rotation force as well as axial driving force for driving and fastening a screw into a workpiece.

For example, WO2008/085465 discloses a combustion type fastener driving tool utilizing a combustion pressure as a power source. In the fastener driving tool, linear driving of a screw until the screw is brought into abutment with a workpiece is provided by a linear movement of a piston driven by the combustion pressure, whereas rotational driving of the screw is provided by an electric motor. For rotating the screw, a drive bit is rotated by the motor while the piston is locked at its bottom dead center position by a solenoid. That is, screw fastening state is maintained by locking the piston with the solenoid. Upon completion of the screw fastening, the piston is unlocked, so that the piston is moved to its top dead center by a biasing force of a spring.

According to the structure disclosed in WO2008/085465 publication, the electric motor is used as the drive source for rotating the screw in addition to the drive source of combustion pressure by the combustible gas. For the fastener driving tool using the combustible gas, an electrical power source for an ignition plug and a fan motor for agitating the combustible gas is provided. Additional provision of the electric motor for rotating the screw causes an increase in electric power consumption. Therefore, frequent power charging must be required if the battery has a small capacity, thereby lowering workability. Frequent charging may be avoidable if a battery having a large capacity is used. However, bulky battery must be used to increase a total weight of the fastener driving tool, to thus degrade operability. Further, the electric motor for rotating the screw is also a heavy component, which leads to increase in total weight of the fastener driving tool.

Further, according to the disclosed faster driving tool, screw fastenable state can be maintained for a prolonged period of time. However, additional components are required such as the solenoid for locking the piston at the bottom dead center. Therefore, the number of parts and components for constituting the fastener driving tool are increased, which renders the resultant tool bulky.

Further, in another aspect, if the rotation of the driver bit is started after the driver bit reaches its bottom dead center, a user must holdingly and pressingly displaces the tool body toward the workpiece by a driving depth of the screw into the workpiece. Such labor produces fatigue of the user. Therefore, it is necessary to provide a compact and light-weight fastener driving tool capable of providing high operability.

Japanese Patent No. 3651988 discloses a nail driving tool utilizing the combustion pressure. A fan is provided for agitating air/fuel mixture, and rotation speed of the fan is changeable in accordance with a length of the nail or hardness of the workpiece in order to change combustion energy output, i.e., a driving force. More specifically, constant rotation number of the fan in accordance with the length of the nail is set during an overall operational phase from the nail driving phase and to a scavenging phase through a piston returning phase.

Therefore, setting of low rotation number of the fan leads to insufficient scavenging ability because the low rotation is also applied at a suction phase as well as scavenging phase.

Solution to Problem

It is therefore an object of the present invention is to provide a combustion-powered fastener driving tool capable of providing rotation force as well as axial driving force for fastening and driving a fastener into a workpiece.

Another object of the invention is to provide a compact and light-weight fastener driving tool capable of providing high operability.

This and other objects of the present invention will be attained by a housing, a cylinder, a combustion chamber frame, a first piston, a second piston, a bit, a rod, and a motion conversion mechanism. The cylinder includes a first cylinder fixed to the housing and a second cylinder fixed to the housing. The combustion chamber frame is movable in the housing and defines a combustion chamber in cooperation with the cylinder. The first piston is slidably reciprocally movable relative to the first cylinder and is displaced upon expansion of air/fuel mixture in the combustion chamber. The second piston is slidably reciprocally movable relative to the second cylinder and is displaced upon expansion of air/fuel mixture in the combustion chamber. The bit extends from the first piston and has a base end portion supported to the first piston and rotatable about its axis, and a free end portion engageable with a fastener. The bit is linearly movable in accordance with the movement of the first piston. The rod extends from the second piston and has a rack. The rod is linearly movable in accordance with the movement of the second piston. The motion conversion mechanism has a first part engageable with the rack, and a second part engaged with the bit for converting the linear movement of the rod into a rotational movement of the bit.

With this structure, expansion of the ignited air-fuel mixture displaces the first and second pistons to linearly move the bit by the first piston and to rotate the bit by the second piston, the rod, the rack, and the motion conversion mechanism. Therefore, a fastener is not only linearly driven but also rotationally driven into the workpiece by the combustion pressure only. A hose required for supplying compressed air to a pneumatically operated fastener driving tool and an electric cord required in an electrical fastener driving tool are dispensed with. Thus, the fastener tool according to the invention provides improved portability and operability.

The above-described fastener driving tool further includes a magazine and a push lever. The magazine is connected to the housing for accommodating the fastener and for guiding movement of the fastener to a fastening position. The push lever is movable relative to the housing upon depression to a workpiece. The combustion chamber frame is movable in the housing in accordance with the movement of the push lever. The first piston selectively provides the combustion chamber in accordance with the movement of the combustion chamber frame. The second piston selectively provides a combustion chamber in accordance with the movement of the combustion chamber frame. The free end of the bit is engagable with the fastener positioned at the fastening position.

In the above-described fastener driving tool, the rack is configured to be positioned on the rod so that a start timing of the engagement between the rack and the first part is later than a start timing of the liner movement of the bit, whereby the rotation of the bit is started after elapse of a predetermined time period during which the bit linearly drives the fastener into the workpiece by a predetermined depth.

With this structure, since the rotation of the fastener is started after the fastener has been linearly driven into the workpiece by a predetermined length, impact from the fastener against the workpiece can be moderated or reduced in comparison with a case where linear driving and rotational driving of the fastener occur simultaneously. Thus, any drift of the workpiece during fastener driving operation can be restrained, and sharpshooting of the fastener against the workpiece can be attained.

Preferably, the housing includes a first housing, and a second housing connected thereto, and the combustion chamber frame includes a first combustion chamber frame disposed within the first housing, and a second combustion chamber frame disposed within the second housing, and, the first cylinder is configured to guide the movement of the first combustion chamber frame, and the second cylinder is configured to guide the movement of the second combustion chamber frame.

With this structure, the second piston is exposed to the second combustion chamber, so that explosion and expansion energy in the second combustion chamber exclusively applies to the second piston. Accordingly, greater rotation force can be obtained to ensure rotational fastening with respect to a workpiece having high hardness.

Preferably, the fastener driving tool further includes a link having one end pivotally movably connected to the push lever and having another end pivotally movably connected to the second combustion chamber frame. The link provides a tilting posture changeable in accordance with the movement of the push lever. The first combustion chamber frame is movable in accordance with a movement of the push lever, and the second combustion chamber frame is movable through the link.

With this structure, movement of the second combustion chamber frame can be provided by the link connected to the push lever. Thus, parts and components can be reduced, to lower production cost and to realize light weight tool.

Preferably, the fastener driving tool further includes a first ignition plug disposed in the first housing and providing a first ignition timing, and a second ignition plug disposed in the second housing and providing a second ignition timing later than the first ignition timing such that a start timing for starting engagement of the rack with the motion converting mechanism occurs after the fastener has been driven into a workpiece by a predetermined amount by the bit.

With this structure, since the rotation of the fastener is started after the fastener has been linearly driven into the workpiece by a predetermined length, impact from the fastener against the workpiece can be moderated or reduced in comparison with a case where linear driving and rotational driving of the fastener occur simultaneously. Thus, any drift of the workpiece during fastener driving operation can be restrained, and sharpshooting of the fastener against the workpiece can be attained.

In the fastener driving tool, the first cylinder defines a first cylinder chamber and has a first opening. A first combustion chamber is defined in cooperation with a portion of the first cylinder including the first opening. A fuel is injected into the first combustion chamber. The fastener driving tool further includes a first cylinder head, a first fan, and a drive control device. The first cylinder head is disposed to confront the first opening and defines the first combustion chamber upon contact with the first combustion chamber frame. The first fan is rotatably provided at the first cylinder head and is exposed to the first combustion chamber. The drive control device controls rotation of the first fan such that the first fan rotates at a first rotation speed during gas exhaust and air suction phases in the first combustion chamber, and the first fan rotates at a second rotation speed lower than the first rotation speed or the rotation of the first fan is stopped when the fuel is introduced into the first combustion chamber and the fuel is combusted in the first combustion chamber.

With this structure, decrease in rotation number of the first fan or stopping rotation of the first fan will lower combustion speed of the fuel injected into the first combustion chamber. In accordance with the lowering of the combustion speed, pressure increase in the first combustion chamber will be moderated, and the first combustion chamber maintains combustion pressure higher than an atmospheric pressure for a prolonged period of time. Since the first piston moves because of the pressure difference between the combustion pressure and the atmospheric pressure, operation period of the bit provided at the first piston for linearly driving the fastener can be maintained for the prolonged period of time because of maintaining the combustion pressure for the prolonged period of time. Further, the first fan recovers its normal rotation at the suction and exhaust cycle, thereby maintaining suction and exhaust efficiency. Accordingly, incomplete combustion can be restrained, and desirable combustion of the injected fuel can be provided.

In the fastener driving tool, the second cylinder defines a second cylinder chamber and has a second opening. A second combustion chamber is defined in cooperation with a portion of the second cylinder including the second opening. A fuel is injected into the second combustion chamber. The fastener driving tool further includes a first ignition plug, and a second ignition plug. The first ignition plug is exposed to the first combustion chamber for igniting the fuel in the first combustion chamber. The second ignition plug is exposed to the second combustion chamber for igniting the fuel in the second combustion chamber. The first ignition plug is ignited prior to an ignition of the second ignition plug.

With this structure, the fastener such as a screw can be subjected to rotation force while the screw is being urged by the bit.

The fastener driving tool further includes a second cylinder head and a second fan. The second cylinder head is disposed to confront the second opening and defines the second combustion chamber upon contact with the second combustion chamber frame. The second fan is rotatably provided at the second cylinder head and is exposed to the second combustion chamber. The drive control device further controls rotation of the second fan.

With this structure, the first and second pistons can be driven by the single power source (fuel combustion force). Therefore, simple power source system can be provided with reducing the number of components, thereby providing a compact tool.

In the fastener driving tool, the first cylinder and the second cylinder are juxtaposed with each other in a single housing. Each of the first cylinder and the second cylinder has one end portion and another end portion.

In the fastener driving tool, the combustion chamber is a single combustion chamber provided at each one end portion of the first cylinder and the second cylinder. The first cylinder and the second cylinder are juxtaposed with each other in the single combustion chamber frame such that the first cylinder and the second cylinder are configured in combination to guide a movement of the single combustion chamber frame.

With this structure, because of the single combustion chamber, light weight and compact fastener driving tool can be provided. Further, consumption of the combustible gas can be reduced to reduce running cost.

In the above-described tool, the first piston and the second piston are simultaneously movable toward their bottom dead centers. The rack is so positioned on the rod that a timing for starting engagement of the rack with the motion converting mechanism occurs after the fastener has been driven into a workpiece by a predetermined amount by the bit.

With this structure, the rotation of the fastener can be started after the fastener has been linearly driven into the workpiece by a predetermined length. Accordingly, the advantage the same as those described above can be obtained.

The fastener driving tool further includes a retard mechanism that causes a start timing of moving the second piston from one end portion of the second cylinder to the another end portion of the second cylinder to be later than a start timing of moving the first piston from one end portion of the first cylinder to the another end portion of the first cylinder.

With this structure, the operation start timing of the second piston is later than the operation start timing of the first piston. Therefore, rotation of the fastener such as a screw will be started after the screw has been pressed against the workpiece by the first piston. Accordingly the screw can be sufficiently screwed into the workpiece, to enhance workability and to avoid any disadvantage of insufficient screwing, such as floating a screw head from the surface of the workpiece. Since the screw can be sufficiently screwed into the workpiece, labor of positively pressing the tool against the workpiece can be reduced or can be dispensed with, thereby cutting back the workload.

In the above-described tool, the combustion chamber is a single combustion chamber provided at each one end portion of the first cylinder and the second cylinder. The first cylinder defines therein a first cylinder chamber, and the second cylinder defines therein a second cylinder chamber The first cylinder chamber and the second cylinder chamber are in communication with the single combustion chamber.

With this structure, mechanical components can be reduced to realize a compact tool, since respective combustion chambers are not required for respective cylinders.

In the above-described tool, the first cylinder defines an axial direction. The rod has an engagement portion providing a locus in accordance with the movement of the second piston between the one end portion and the another end portion of the second cylinder. The retard mechanism includes an actuator movable in a direction crossing the axial direction, between a protruding position and a retracting position. At the protruding position the actuator is engaged with the engagement portion to prevent the rod from moving from the one end portion toward the another end portion during an initial moving phase of the first piston from the one end portion toward the another end portion. At the retracting position, the actuator is retracted from the locus to permit the rod from moving past the actuator from the one end portion toward the another end portion at a timing later than a timing of starting the movement of the first piston toward the another end portion.

Alternatively, the first cylinder defines therein a first cylinder chamber, and also defines an axial direction. The rod has an engagement portion providing a locus in accordance with the movement of the second piston between the one end portion and the another end portion of the second cylinder. The retard mechanism includes a stop member and a biasing member. The stop member is movable between a protruding position and a retracting position and has a pivot shaft portion, a first arm, and a second arm. The pivot shaft portion is pivotally movably supported to the cylinder and extends in a direction perpendicular to the axial direction. The first arm extends from the pivot shaft portion and is movable between the protruding position protrudable into the first cylinder chamber and the retracting position retractable therefrom. The second arm extends from the pivot shaft portion and is movable between the protruding position engageable with the engagement portion at the protruding position of the first arm and the retracting position retracting from the locus at the retracting position of the first arm. The first piston is abuttable against the first arm while the first arm is at the protruding position when the first piston is moved from the one end portion to the another end portion to move the first arm and the second arm to the retracting position. The biasing member is interposed between the cylinder and the stop member and biases the stop member toward the protruding position.

Further alternatively, the first cylinder and the second cylinder define therein a first cylinder chamber, and a second cylinder chamber, respectively. The retard mechanism includes a fluid passage section having a first opening open to the first cylinder chamber and a second opening open to the second cylinder chamber for providing a fluid communication between the first cylinder chamber and the second cylinder chamber. The first opening is positioned such that the first piston shuts off fluid communication between the combustion chamber and the first opening when the first piston is positioned at the one end portion of the first cylinder, and the first piston firstly allows the first opening to communicate with the combustion chamber when the first piston is moved toward the another end portion of the first cylinder by a predetermined distance, the second cylinder chamber being commuicatable with the combustion chamber through only the fluid passage section.

In the further alternative, the retard mechanism further includes a partition wall partitioning an upper space of the second cylinder chamber above the second piston from the combustion chamber to prevent the second piston from moving toward the another end portion during initial combustion state in the combustion chamber.

In the above-described fastener driving tools, attention is drawn to the driving of the first and second pistons by the combustion force only, and first through seventh embodiments use the combustion force only. However, the present inventors conceive inventions from a different aspect in terms of linear driving time period in connection with the rotational driving time period. The latter aspect is described in detail with reference to sixth and seventh embodiments, and is summarized below.

A combustion type fastener driving tool comprises an impact mechanism that imparts an impact force on a screw, and a rotation force applying mechanism that applies rotation force to the screw. The impact mechanism includes a first cylinder, a first combustion chamber frame, a first piston, a first cylinder head, a first fan, and a drive control device. The first cylinder defines a first cylinder chamber and has a first opening. The first combustion chamber frame is provided at the first cylinder and defines a first combustion chamber in cooperation with a portion of the first cylinder including the first opening. A fuel is injected into the first combustion chamber. The first piston is movably disposed in the first cylinder chamber and is driven upon combustion of the fuel. The first piston has a bit for impacting the screw in an axial direction and rotatable about an axis thereof for rotating the screw about its axis. The first cylinder head is disposed to confront the first opening and defines the first combustion chamber upon contact with the first combustion chamber frame. The first fan is rotataly provided at the first cylinder head and is exposed to the first combustion chamber. The drive control device controls rotation of the first fan such that the first fan rotates at a first rotation speed during gas exhaust and air suction phases in the first combustion chamber, and the first fan rotates at a second rotation speed lower than the first rotation speed or the rotation of the first fan is stopped when the fuel is introduced into the first combustion chamber and the fuel is combusted in the first combustion chamber.

With this structure, decrease in rotation number of the fan or stopping rotation of the fan will lower combustion speed of the fuel injected into the combustion chamber. In accordance with the lowering of the combustion speed, pressure increase in the combustion chamber will be moderated, and the combustion chamber maintains combustion pressure higher than an atmospheric pressure for a prolonged period of time. Since the piston moves because of the pressure difference between the combustion pressure and the atmospheric pressure, operation period of the bit provided at the piston for linearly driving the fastener can be maintained for the prolonged period of time because of maintaining the combustion pressure for the prolonged period of time. Further, the fan recovers its normal rotation at the suction and exhaust cycle, thereby maintaining suction and exhaust efficiency. Accordingly, incomplete combustion can be restrained, and desirable combustion of the injected fuel can be provided.

In the combustion type fastener driving tool, the impact mechanism further comprises a first ignition device exposed to the first combustion chamber for igniting the fuel. The first ignition device being operated prior to an operation of the rotation force applying mechanism.

With this structure, the fastener such as a screw can be subjected to rotation force while the screw is being urged by the bit. Therefore, rotation drive mechanism can be operated without wasting its inherent performance.

In the combustion type fastener driving tool, the rotation force applying mechanism includes a motion conversion mechanism engaged with the bit, a second cylinder, a second combustion chamber frame, a second piston, a second cylinder head, a second fan, and a second ignition device. The second cylinder defines a second cylinder chamber and has a second opening. The second combustion chamber frame is provided at the second cylinder and defines a second combustion chamber in cooperation with a portion of the second cylinder including the second opening. A fuel is injected into the second combustion chamber. The second piston is movably disposed in the second cylinder chamber and is driven upon combustion of the fuel. The second piston has a rod engaged with the motion conversion mechanism. The second cylinder head is disposed to confront the second opening and defines the second combustion chamber upon contact with the second combustion chamber frame. The second fan is rotatably provided at the second cylinder head and is exposed to the second combustion chamber. The second ignition device is exposed to the second combustion chamber for igniting the fuel. The drive control device further controls rotation of the second fan.

With this structure, the rotation drive mechanism and the linear driving mechanism can be operated by the single power source (fuel combustion force). Therefore, simple power source system can be provided with reducing the number of components, thereby providing a compact tool.

Advantageous Effects of Invention

As described above, a combustion-powered fastener driving tool capable of providing rotation force as well as axial driving force for fastening and driving a fastener into a workpiece can be provided. Further, a compact and light-weight fastener driving tool capable of providing high operability can be provided.

BRIEF DESCRIPTION OF DRAWINGS

In the drawings;

FIG. 5(*b*) is a cross-sectional view taken along the line Vb-Vb of FIG. 4;

FIG. 18(*b*) is a graph showing a change in displacement (D) of a bit and rotation amount (R) of the bit relative to a time t in the fastener driving tool according to the sixth embodiment;

DESCRIPTION OF EMBODIMENTS

Figure 1:
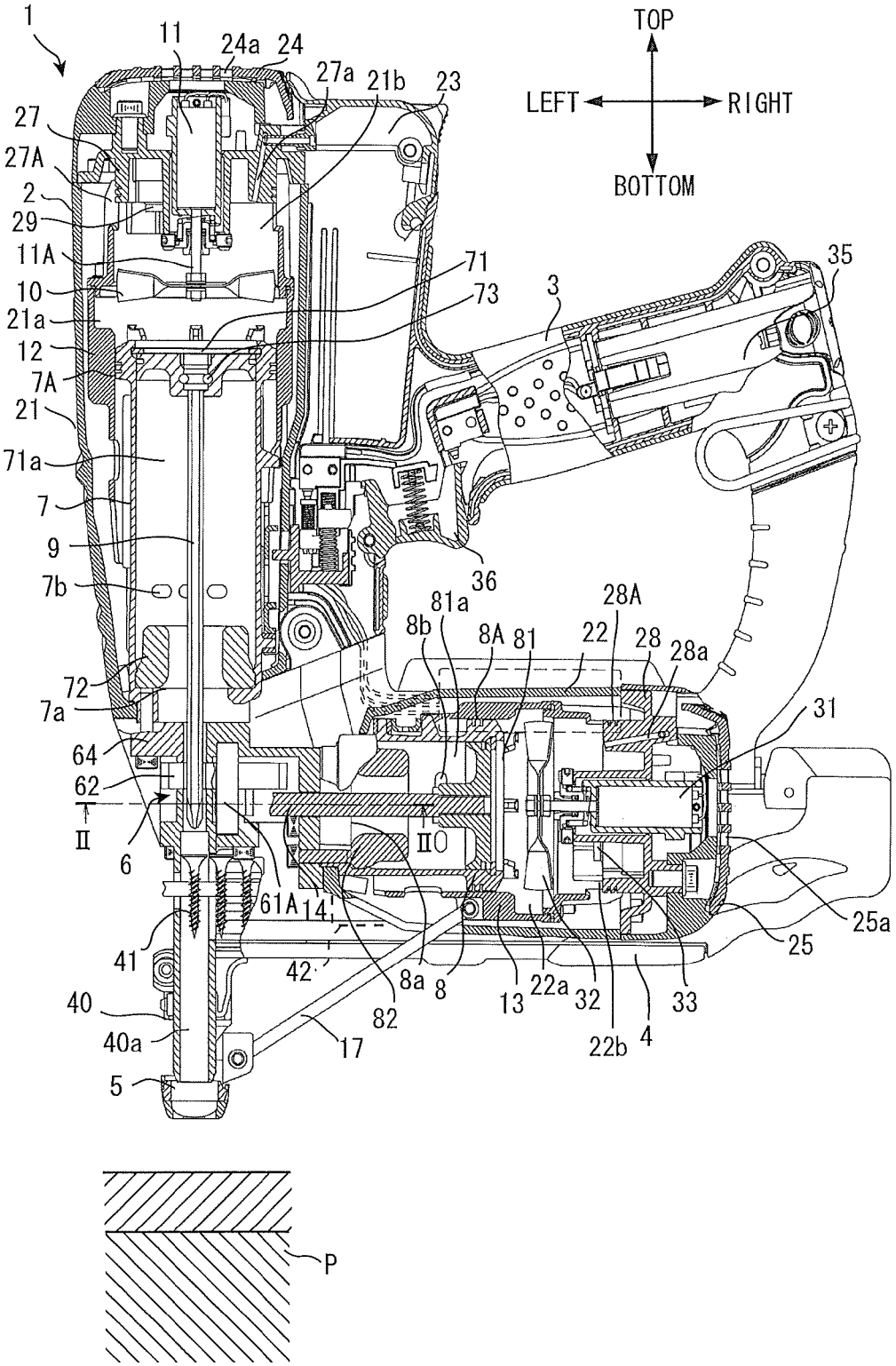
FIG. 1 is a cross-sectional view of a fastener driving tool according to a first embodiment of the present invention.

A fastener driving tool according to a first embodiment of the present invention will be described with reference to FIGS. 1 through 3. The fastener driving tool 1 includes a housing 2, a handle 3, a magazine 4, a push lever 5, and a motion conversion mechanism 6. Throughout the specification, a direction from the handle 3 to the magazine 4 will be referred to as a "downward direction", and its opposite direction will be referred to as an "upward direction". Further, a direction from the magazine 4 to the push lever 5 will be referred to as "leftward", and its opposite direction will be referred to as "rightward".

The housing 2 includes a first housing 21, a second housing 22, a canister retaining portion 23, a first head cover 24 and a second head cover 25. The motion conversion mechanism 6 is provided below the first housing 21, and the push lever 5 is provided to the lower side of the motion conversion mechanism 6. The first housing 21 has a lower right side from which the second housing 22 extends rightward. The canister retaining portion 23 is positioned at right side of the first housing 21, and the handle 3 extends rightward from the canister retaining portion 23.

Within the first housing 21, a first cylinder 7, a bit 9, a first fan 10, a first fan motor 11, a first combustion chamber frame 12, and a first cylinder head 27 are provided.

The first cylinder 7 is accommodated in the first housing 21, and has an upper opening and has a hollow cylindrical shape whose axis extends in a vertical direction. The first cylinder 7 defines a first cylinder chamber 71*a* therein. An upper outer peripheral portion near the upper opening is provided with a seal portion 7A in intimate contact with an inner peripheral surface of the first combustion chamber frame 12. The first cylinder 7 has a bottom wall formed with a bore 7*a* which allows the bit 9 to pass therethrough. Further, a spring (not shown) is provided at a lower portion of the first cylinder 7 to bias the first combustion chamber frame 12 downward.

The lower portion of the first cylinder 7 is formed with a vent hole 7*b* communicating with an exhaust port (not shown) formed in the first housing 21 and penetrating from inside of the first cylinder chamber 71*a* to outside thereof. A check valve (not shown) is provided at the vent hole 7*b* to exclusively allow combustion gas to flow from an interior of the first cylinder 7 to an exterior thereof. Further, an exhaust cover (not shown) is provided for covering the vent hole 7*b*.

A first piston 71 and a first bumper 72 are provided in the first cylinder chamber 71*a*. The first piston 71 has a generally circular disk cross-section in a direction orthogonal to the vertical direction and is in hermetic sliding contact with an inner peripheral surface of the first cylinder 7 through a plurality of seal members, so that the first piston 71 divides the first cylinder chamber 71*a* into an upper chamber and a lower chamber. The first piston 71 is movable to a top dead center as shown in FIG. 1 in which an upper surface of the first piston 71 is substantially flash with an upper end face of the first cylinder 7. The first piston 71 has a lower end portion provided with a bearing 73.

The bit 9 has a polygonal shape cross-section (regular hexagonal cross-section in the embodiment), and has a tip end (bottom end) portion shaped to be engageable with a head of screw 41. The tip end portion extends to an outside of the first cylinder 7 through the bore 7*a*. The bit 9 has a base end (top end) connected to a lower end portion of the first piston 71 through the bearing 73. Thus, the bit 9 is rotatable about its axis and is supported to the first piston 71.

The first bumper 72 made from an elastic material such as rubber is disposed at an inside of the first cylinder chamber 71*a* and lower end portion of the first cylinder 7 at a position immediately below the first piston 71. Accordingly, direct abutment of the first piston 71 against a wall of the first cylinder 7 around the bore 7*a* can be prevented by the first bumper 72. Further, the first bumper 72 is adapted to absorb impact force of the first piston 71 during screw driving phase. The abutment position between the first piston 71 and the first bumper 72 is a bottom dead center of the first piston 71.

The first combustion chamber frame 12 disposed in the first housing 21 has a hollow cylindrical shape having open ends, and is disposed over the first cylinder 7. The first combustion chamber frame 12 is vertically reciprocally movable relative to the first cylinder 7, and has an inner peripheral surface in hermetic contact with the seal portion 7A when the first combustion chamber frame 12 is elevated against the biasing force of the spring (not shown). The first combustion chamber frame 12 has a lower end portion integrally provided with a first link member (not shown) that is connected to the push lever 5.

The first cylinder head 27 is positioned above the first combustion chamber frame 12, and is fixed to the first housing 21. The first cylinder head 27 has a lower portion provided with a seal portion 27A with which an upper inner peripheral surface portion of the first combustion chamber frame 12 is in contact. Upon intimate contact with the seal portion 27A with the upper inner peripheral surface portion, a first combustion chamber 21*a* is defined. More specifically, by the upward movement of the first combustion chamber frame 12, the upper inner peripheral surface portion of the first combustion chamber frame 12 is brought into intimate contact with the seal portion 27A, whereupon the first combustion chamber 21 is defined by an upper surface of the first piston 71, the upper surface of the first cylinder 7, the first combustion chamber frame 12, and a lower surface of the first cylinder head 27. The first combustion chamber 21*a* can be fluid-tightly maintained because of the intimate contact between the seal portion 27A and the upper inner peripheral surface portion of the first combustion chamber frame 12, and between the seal portion 7A and the inner peripheral surface of the first combustion chamber frame 12. Incidentally, reference numeral 21*b* designates a first vent hole provided when the upper end portion of the first combustion chamber frame 12 is out of contact from the seal portion 27A.

The first fan motor 11 is held by the first cylinder head 27 and has a rotation shaft 11A extending in the vertical direction and protruding into the first combustion chamber 21*a*. A first ignition plug 29 is also held by the first cylinder head 27. A head switch (not shown) is provided in the first housing 21 to detect an upper stroke end position of the first combustion chamber frame 12 as a result of pushing the push lever 5 against a workpiece P. The head switch (not shown) is rendered ON when the push lever 5 is elevated to a predetermined position, i.e., the upper inner peripheral surface of the first combustion chamber frame 12 is in intimate contact with the seal portion 27A so that the first combustion chamber 21*a* is formed, whereupon rotation of the first fan motor 11 and a second fan motor 31 (described later) will be started.

The first fan 10 is fixedly mounted on a lower portion of the rotation shaft 11A, and is exposed to the first combustion chamber 21*a*. In a state where the first combustion chamber frame 12 is in contact with the first cylinder head 27, the rotation of the first fan 10 promotes agitation between air and combustible gas, generates turbulent combustion upon ignition for promoting combustion, and discharges exhaust gas after combustion of the combustible gas out of the first combustion chamber 21*a*.

The first ignition plug 29 is disposed at the upper region of the first combustion chamber 21*a* for igniting combustible gas supplied thereinto. Further, the first cylinder head 27 is formed with a first fuel passage 27*a* for introducing combustible gas from a gas canister (not shown) mounted in the canister retaining portion 23 into the first combustion chamber 21*a*.

A second cylinder 8, a second combustion chamber frame 13, a rod 14, a second fan 32, a second fan motor 31 and a second cylinder head 28 are provided in the second housing 22. The structure in the second housing 22 is substantially similar to that in the first housing 21, and therefore, like parts and components in the second housing 22 will be briefly described.

The second cylinder 8 is accommodated in the second housing 22, defines a second cylinder chamber 81*a* therein, and has a hollow cylindrical shape whose axis extends in rightward/leftward direction. The second cylinder 8 has a left end portion formed with a bore 8*a*, and has an outer peripheral right end portion provided with a seal portion 8A in contact with the second combustion chamber frame 13. The second cylinder 8 is formed with a vent hole 8*b* where a check valve (not shown) is provided. Further, a second piston 81 and a second bumper 82 are provided in the second cylinder chamber 81*a*. The second bumper 82 made from an elastic material such as rubber is positioned at the left end portion of the second cylinder 8 so as to absorb impact of the second piston 81. The second piston 81 is reciprocally movable in rightward/leftward direction in the second cylinder chamber 81*a*.

The rod 14 has a left end portion formed with a rack 14A having a predetermined length. The rack 14A is in meshing engagement with the motion conversion mechanism 6. The rod 14 has a right end portion concentrically fixed to the second piston 81.

The second combustion chamber frame 13 is movable in rightward/leftward direction relative to the second cylinder 8. The second combustion chamber frame 13 has a longitudinally intermediate portion to which one end of a second link member 17 is pivotally movably connected. The second link member 17 has another end pivotally movably connected to the push lever 5. Therefore, the second combustion chamber frame 13 is moved rightward and leftward in interlocking relation to the vertical movement of the push lever 5. That is, the second combustion chamber frame 13 is moved rightward and leftward in response to upward movement and downward movement of the push lever 5, respectively. Further, the second combustion chamber frame 13 is biased leftward by a spring (not shown) relative to the second cylinder 8. The seal portion 8A is adapted to maintain fluid-tightness between the second combustion chamber frame 13 and the second cylinder 8.

The second cylinder head 28 is positioned at a right side of the second combustion chamber frame 13, and has a left end portion provided with a seal portion 28A. Intimate contacts between the seal portion 28A and the second combustion chamber frame 13 and between the seal portion 8A of the second cylinder 8 and the second combustion chamber frame 13 can provide hermetic second combustion chamber 22*a*.

The second fan motor 31 and a second ignition plug 33 are held in the second cylinder head 28. The second cylinder head 28 is formed with a second fuel passage 28*a* for introducing a combustible gas into the second combustion chamber 22*a*.

The gas canister retaining portion 23 is positioned at one side of the first housing 21 and extends in a vertical direction for retaining therein a gas canister (not shown). The gas canister accommodates therein the combustible gas and is configured to eject the combustible gas by a predetermined amount. The gas canister is tiltable toward the first cylinder head 27 in accordance with the movement of the push lever 5, and has a gas ejecting portion (not shown) in fluid communication with the first fuel passage 27*a* and the second fuel passage 28*a*. Accordingly, the combustible gas can be ejected into the first and second combustion chambers 21*a* and 22*a*.

The first head cover 24 is disposed above the first housing 21 and is formed with a plurality of air intake ports 24*a* through which fresh air can be introduced into the first combustion chamber 21*a* in accordance with the rotation of the first fan 10.

The second head cover 25 is positioned at right side of the second housing 22 and is formed with a plurality of air intake ports 25*a* through which fresh air can be introduced into the second combustion chamber 22*a* in accordance with the rotation of the second fan 32.

The handle 3 extends from the gas canister retaining portion 23 in a direction away from the first housing 21, and has a trigger 36 and a battery 35 detachably mounted thereon. The trigger 36 is adapted to supply electrical current to the first and second ignition plugs 29, 33 provided at the first and second cylinder heads 27, 28, respectively, upon pulling the trigger 36 to ignite the air/fuel mixture in the first combustion chamber 21*a* and the second combustion chamber 22*a*.

The magazine 4 is positioned below the handle 3 and is generally aligned with the second housing 22 in the vertical direction. A plurality of fasteners such as screws 41 are arrayed inside the magazine 4. The magazine 4 has an internal portion in communication with an injection passing 40*a* of a nose portion 40 described later and provided with a feeder 42 for feeding the plurality of screws 41 to the injection passing 40*a*.

The nose portion 40 is adapted to confront the workpiece P, and is positioned below the motion conversion mechanism 6. The nose portion 40 formed with the injection passage 40*a* along which the bit 9 and the screw 41 are traveled. The push lever 5 is provided to the nose portion 40 and is vertically movable relative to the nose portion 40. The push lever 5 is connected to the first link member (not shown) and the second link member 17. A biasing member such as a spring (not shown) is interposed between the push lever and the nose portion 40 so as to urge the push lever 5 downward.

Figure 2:
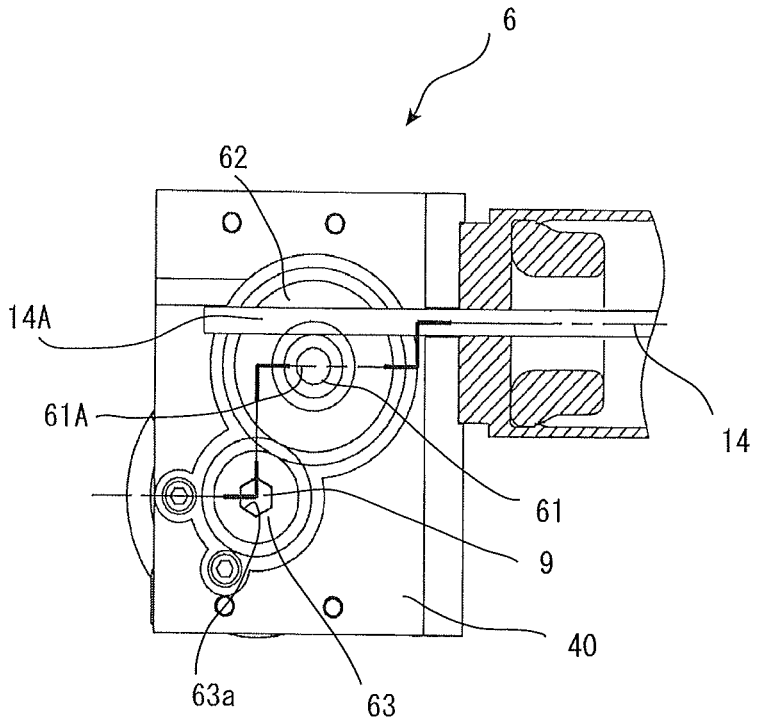
FIG. 2 is a cross-sectional view taken along the line II-II of FIG. 1.

The motion conversion mechanism 6 is positioned between the nose portion 40 and the first cylinder 7 and includes a pinion 61, a first gear 62, and a second gear 63 as shown in FIG. 2. The pinion 61 has a pinion shaft 61A rotatably supported to the nose portion 40, and is meshingly engaged with the rack 14A of the rod 14. The first gear 62 is coaxially fixed to the pinion shaft 61A, and is meshingly engaged with the second gear 63. The second gear 63 is rotatably supported in the nose portion 40, and has a rotation center formed with a hexagonal insertion hole 63*a* through which the bit 9 extends. In other words, the bit 9 and the second gear 63 are rotatable coaxially with each other. Upon movement of the rod 14 in its longitudinal direction, the pinion 61 meshed with the rack 14A is rotated. Thus, linear movement of the rod 14 can be converted into a rotational motion. The rotation of the pinion 61 is transmitted to the first gear 62 through the pinion shaft 61A to rotate the second gear 63 meshed with the first gear 62. Thus, the rotation of the second gear 63 is transmitted to the bit 9, so that the bit 9 is rotated about its axis.

Movement of the rod 14 provides rotation of the pinion 61 meshed with the rack 14A to convert the linear movement of the rod 14 into rotational movement of the pinion 61. Rotation of the pinion 61 is transmitted through the shaft 61A to the first gear 62 coaxial with the pinion 61, so that the second gear 63 meshed with the first gear 62 rotates. Accordingly, the rotation of the second gear 63 is transmitted to the bit 9 extending through the insertion hole 63*a* of the second gear 63. Since the rack 14A and the pinion 61 are continuously meshed with each other and since the bit 9 extends through the insertion hole 63*a*, moving amount of the rod 14 is proportional to rotation amount of the bit 9. Since the moving amount of the rod 14 is equal to the moving amount of the second piston 81, moving amount of the second piston 81 is proportional to the rotation amount of the bit 9. Further, since the moving stroke of second piston 81 is limited between its top dead center and the bottom dead center, the rotating period of the second gear 63 (bit 9) is the moving period of the second piston from the top dead center to the bottom dead center.

Operation of the fastener driving tool 1 will next be described with reference to FIGS. 1 through 3. In a non-operational phase as shown in FIG. 1, the push lever 5 is biased downward by the biasing force of the spring (not shown), so that the tip end of the push lever 5 is positioned downward of the nose portion 40. In this case, the upper end of the first combustion chamber frame 12 is separated from the seal portion 27A of the first cylinder head 27. Thus, the first vent hole 21*b* is defined between the upper end portion of the first combustion chamber frame 12 and the first cylinder head 27. Further, the first piston 71 is positioned at its top dead center, and a second vent hole (not shown) is defined between the seal portion 7A and the first combustion chamber frame 12. The right end portion of the second combustion chamber frame 13 is separated from the seal portion 28A of the second cylinder head 28, so that a third vent hole 22*b* is defined therebetween. In this case, the second piston 81 is at is top dead center. Further, a fourth vent hole (not shown) is defined between the seal portion 8A and the second combustion chamber frame 13.

Figure 3:
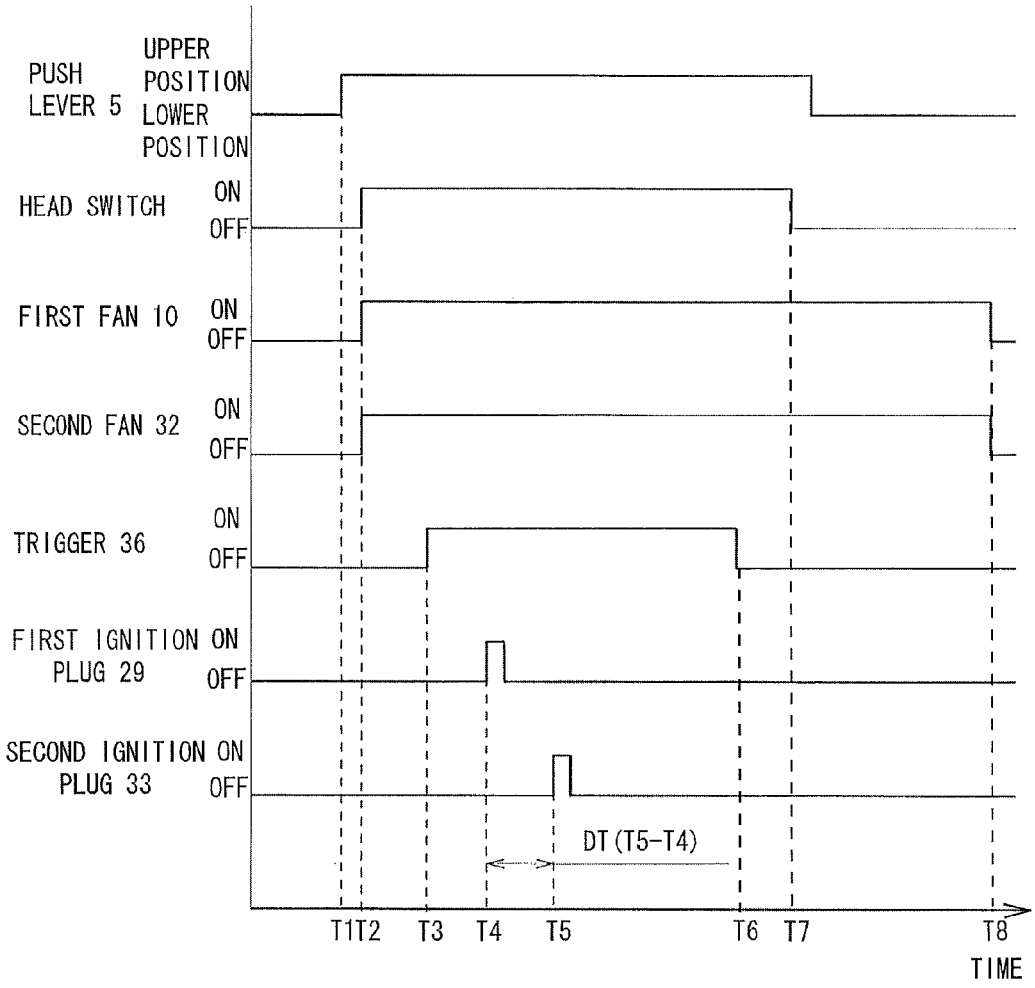
FIG. 3 is a time chart illustrating operation timing and period of respective components in the fastener driving tool according to the first embodiment.

When a user grips the handle 3 and pushes the push lever 5 against the workpiece P, the push lever 5 is moved upward against the biasing force of the spring (not shown) at a time T1 in FIG. 3, so that the first combustion chamber frame 12 is moved upward through the first link member not shown). By the upward movement, the upper end of the first combustion chamber frame 12 is brought into abutment with the first cylinder head 27 so as to hermetically provide the first combustion chamber 21*a*. Simultaneously, the upward movement of the push lever 5 causes a pivotal motion of the second link member 17 to move the second combustion chamber frame 13 rightward. By this rightward movement, the right end portion of the second combustion chamber frame 13 is brought into abutment with the second cylinder head 28 so as to hermetically provide the second combustion chamber 22*a*.

Further, in accordance with the movement of the push lever 5, the gas canister (not shown) is tilted toward the first cylinder head 27, so that combustible gas accumulated in the gas canister will be ejected once into the first combustion chamber 21*a* and the second combustion chamber 22*a* through the first fuel passage 27*a* and the second fuel passage 28*a*, respectively.

As shown in FIG. 3, when the first and second combustion chamber frames 12 and 13 reach their stroke ends at a timing T2 in FIG. 3 in accordance with the movement of the push lever 5, the head switch (not shown) is turned ON to start electrical power supply to the first and second fan motors 11 and 31, thereby starting rotation of the first and second fans 10 and 32. Accordingly, combustible gas introduced into the combustion chambers 21*a*, 22*a* can be agitatingly mixed with fresh air.

Then, when the trigger 36 is turned ON at a timing T3, the first ignition plug 29 in the first combustion chamber 21*a* is ignited at a timing T4, thereby igniting, combusting, and exploding the air/fuel mixture. Because of the combustion and explosion, the first piston 71 and the bit 9 are moved downward until the first piston 71 abuts against the first bumper 72 in the first cylinder 7. Thus, a screw 41 held in the nose portion 40 is driven into the workpiece P.

After elapsing a predetermined time period DT from the timing T4, i.e., when the time is at T5, the second ignition plug 33 in the second combustion chamber 22*a* is ignited, the second piston 81 and the rod 14 are moved leftward until the second piston 81 abuts against the second bumper 82 in the second cylinder 8. Accordingly, the linear movement of the rod 14 is converted into a rotational movement of the pinion 61, and this rotational force is transmitted to the bit 9 by way of the first and second gears 62, 63. Because of the rotation of the bit 9 about its axis, the screw 41 engaged with the tip end of the bit 9 is also rotated. Therefore, the screw 41 is rotationally driven into the workpiece P.

After the first piston 71 abuts against the first bumper 72, the combustion gas is released to an outside of the first cylinder 7 through the vent hole 7*b*, and therefore, pressure in the first cylinder chamber 71*a* and the first combustion chamber 21*a* will gradually lowered. When the pressure become an atmospheric pressure, the check valve (not shown) provided at the vent hole 7*b* is closed. Similarly, in the second combustion chamber 22*a*, the combustion gas is discharged out of the second cylinder chamber 81*a* through the vent hole 8*b*, and the check valve (not shown) on the vent hole 8*b* will be closed when the pressure in the second cylinder chamber 81*a* and the second combustion chamber 22*a* becomes the atmospheric pressure.

The combustion gas remaining in the first cylinder chamber 71*a*, the first combustion chamber 21*a*, the second cylinder chamber 81*a*, and the second combustion chamber 22*a* has high temperature, and therefore, the combustion heat will be absorbed thereinto. Thus, temperature of the first and second cylinders 7, 8 and first and second combustion chamber frames 12, 13 will be increased. The heat is then released to the atmosphere through the outer surfaces thereof.

Because of the heat absorption into the first cylinder 7 and first combustion chamber frames 12, combustion gas is promptly cooled to decrease a volume thereof. Accordingly, pressure in the upper chamber of the first piston 71 will be decreased to become a pressure not more than the atmospheric pressure to cause a thermal vacuum. As a result, the first piston 71 can be returned to its initial top dead center position. The same is true with respect to the second combustion chamber 22*a*, so that the second piston 81 is returned to its top dead center position because of the thermal vacuum.

Then the trigger is rendered OFF at a timing T6, and the user lifts the fastener driving tool 1 in its entirety to separate the push lever 5 from the surface of the workpiece P. As a result, the first and second combustion chamber frames 12 and 13 are returned to their positions shown in FIG. 1 because of the biasing force of the spring (not shown). Then, the head switch is rendered OFF at a timing T7 elapsing from a predetermined time period from the timing T6. However, the first and second fans 10, 32 continue rotation for a predetermined period of time by a timing T8. Because of the rotation of the first and second fans 10, 32, air flow can be generated in the first and second combustion chamber 21*a*, 22*a*. That is, fresh air is introduced from the air intake ports 24*a*, 25*a* of the first and second head covers 24, 25 into first and second combustion chambers 21*a*, 22*a* through the first vent hole 21*b* and the third vent hole 22*b*, and the air and the residual combustion gas can be discharged through the exhaust port (not shown) of the housing 2. Accordingly, scavenging can be performed with respect to the first and second combustion chambers 21*a*, 22*a*. Then, rotation of the first and second fans 10, 32 is stopped at a timing T8 to provide an initial stationary phase. Then, the above-described operation will be repeatedly performed for successively driving the screws 41 into the workpiece P.

As described above, displacement of the first and second pistons 71, 81 occurs by the expansion of the combustion gas in the first and second combustion chambers 21*a*, 22*a*. The displacement of the first piston 71 provides a linear movement of the bit 9, and displacement of the second piston 81 provides rotational movement of the bit 9. Thus, the screw 41 can be driven into the workpiece P with its linear movement and rotation. Further, a hose for supplying a compressed air in a pneumatically operated screw driver or an electric cord required in an electrically powered screw driver can be dispensed with, thereby enhancing portability and operability.

Further, a delay time period DT is provided between the ignition timing T5 and T6 of the first and second ignition plugs 29 and 33. Therefore, the bit 9 is firstly linearly driven to linearly drive the screw 41 into the workpiece P by the combustion in the first combustion chamber 21*a*, and thereafter, the rotation of the bit 9 will be started by the combustion in the second combustion chamber 22*a* to rotate the screw 41 along with its linear driving movement. With this arrangement, any impact of the screw against the workpiece P can be moderated or reduced in comparison with a case where the rotation and linear movement of the bit 9 are started simultaneously. Consequently, inadvertent displacement of the workpiece P due to screw driving operation can be restrained, and positioning of the screw 41 relative to the workpiece P can be facilitated.

Further, the combustion energy generated in the second combustion chamber 22*a* can be exclusively supplied to the second piston 81. Accordingly, sufficient rotational force can be applied to the bit 9, so that stabilized screw fastening operation can be attained even if the workpiece P has high hardness.

Further, the second link member 17 can provide the movement of the second combustion chamber frame 13 in accordance with the displacement of the push lever 5. Therefore, parts and components can be reduced to produce a lightweight tool at low cost.

Figure 4:
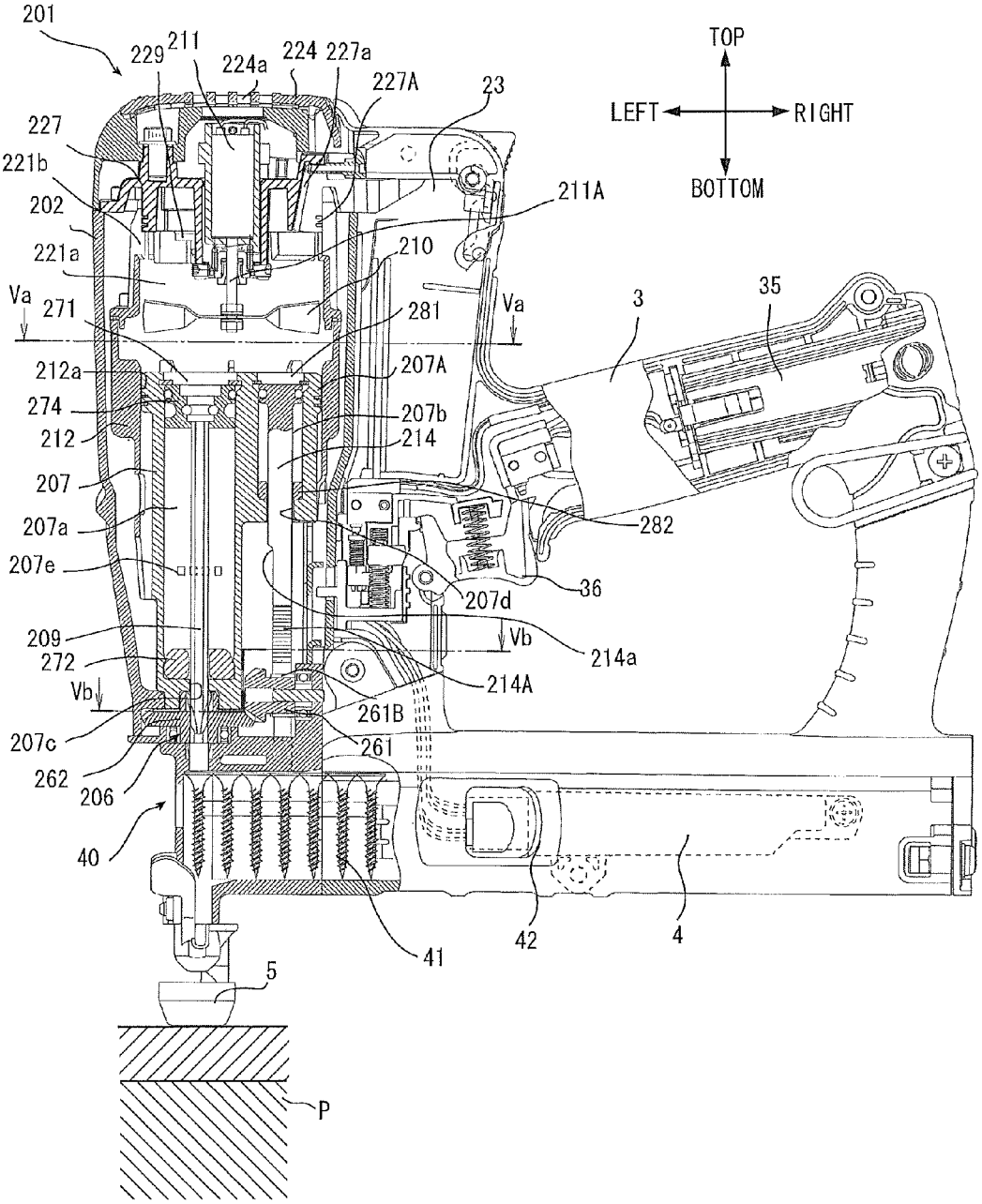
FIG. 4 is a cross-sectional view of a fastener driving tool according to a second embodiment of the present invention.

A fastener driving tool 201 according to a second embodiment of the present invention will be described with reference to FIGS. 4 and 5, wherein like parts and components are designated by the same reference numerals as those shown in FIGS. 1 through 3. The fastener driving tool 201 includes a housing 202, a handle 3, a magazine 4, a push lever 5, and a motion conversion mechanism 206. A direction from the handle 3 to the magazine 4 will be referred to as "downward direction", and a direction opposite thereto will be referred to as "upward direction". Further, a direction from the magazine 4 to the push lever 5 will be referred to as "leftward direction", and a direction opposite thereto will be referred to as "rightward direction".

The housing 202 includes a head cover 224 and a canister retaining portion 23. The motion conversion mechanism 206 is provided to a lower portion of the housing 202, and the nose portion 40 is assembled to a lower portion of the motion conversion mechanism 206. The head cover 224 is positioned at an upper portion of the housing 202.

A cylinder 207, a combustion chamber frame 212, a fan 210, a fan motor 211, and a cylinder head 227 are provided in the housing 202.

The cylinder 207 defines therein a first cylinder chamber 207*a* and a second cylinder chamber 207*b* juxtaposed with each other. The cylinder 207 has an upper portion provided with a seal portion 207A in contact with an inner peripheral surface of the combustion chamber frame 212. The cylinder 207 has a lower portion provided with a spring (not shown) for biasing the combustion chamber frame 212 to its bottom dead center. The first and second cylinder chambers 207*a*, 207*b* have their axes extending in upward/downward direction. As shown in FIG. 4, the first cylinder chamber 207*a* has an internal volume greater than that of the second cylinder chamber 207*b*. The first cylinder chamber 207*a* has a lower portion formed with a bore 207*c* in communication with the atmosphere and through which a bit 209 extends. The second cylinder chamber 207*b* has a lower portion farmed with a bore 207*d* in communication with the atmosphere and through which a rod 214 extends.

A first piston 271 provided with a bearing portion 274, a first bumper 272, and the bit 209 are provided in the first cylinder chamber 207*a*. The first piston 271 has an upper surface flash with an upper end portion of the cylinder 207 when the first piston 271 is at its top dead center. The first piston 271 is of a generally disc like configuration and provided with a plurality of seal members in sliding contact with an inner peripheral surface of the first cylinder chamber 207*a* thereby dividing an interior of the chamber 207*a* into an upper chamber and a lower chamber.

The bit 209 has a polygonal cross-section (regular hexagonal cross-section in the embodiment) and is shaped of a bar extending vertical direction. The bit 209 has a tip end portion configured to be engageable with a head of the screw 41 and an upper end portion connected to a lower end portion of the first piston 271 and rotatably supported to the bearing portion 274. That is, the bit 209 is rotatable about its axis. The tip end portion of the bit 209 extends through the bore 207*c* and protrudes to an outside of the first cylinder chamber 207*a*.

The first bumper 272 made from an elastic material such as rubber is disposed at an inside of and lower end portion of the first cylinder chamber 207*a* at a position immediately below the first piston 271. Accordingly, direct abutment of the first piston 271 against a wall of the cylinder 207 around the bore 207*c* can be prevented by the first bumper 272. Further, the first bumper 272 is adapted to absorb impact force of the first piston 271 during screw driving phase. The abutment position between the first piston 271 and the first bumper 272 is a bottom dead center of the first piston 271.

The lower portion of the first cylinder chamber 207*a* is formed with a vent hole 207*e* in communication with an exhaust port (not shown) formed in the housing 202. A check valve (not shown) is provided at the vent hole 207*e* to exclusively allow combustion gas to flow from an interior of the first cylinder chamber 207*a* to an exterior thereof. Further, an exhaust cover (not shown) is provided for covering the vent hole 207*e*.

A second piston 281, a second bumper 282, and the rod 214 are provided in the second cylinder chamber 207*b*. The second piston 281 has an upper end portion flash with an upper end surface of the cylinder 207 when the second piston 281 is at its top dead center position. As shown in FIG. 5(*a*), an area of the upper surface of the second piston 281 is smaller than that of the first piston 271. By properly setting the difference in a ratio of the areas, a ratio of a downward screw driving force for axially moving the screw 41 to a rotational force for rotating the screw 41 about its axis can be properly set. According to the illustrated embodiment, sufficient downward screw driving force can be provided by setting enlarged area of the upper surface of the first piston 271. The second piston 281 is of a generally disc like configuration and provided with a plurality of seal members in sliding contact with an inner peripheral surface of the sec- and cylinder chamber 207*b* thereby dividing an interior of the second chamber 207*b* into an upper chamber and a lower chamber. The rod 214 has a lower portion formed with a rack 214A having a predetermined length, and has an upper portion connected to a lower portion of the second piston 281. A part of the rod 214 extends through the bore 207*d* and protrudes outside of the second cylinder chamber 207*b*. The rack 214A is configured such that its lower end portion is engagable with the motion conversion mechanism 6 when the second piston 281 is at its top dead center. Further, the rod 214 has a notched portion 214*a* as shown in FIG. 4. The notched portion 214*a* is positioned at a portion protruding outside of the second cylinder chamber 207*b* through the bore 207*d*.

The second bumper 282 made from an elastic material such as rubber is disposed at an inside of and lower end portion of the second cylinder chamber 207*b* at a position immediately below the second piston 281. Accordingly, direct abutment of the second piston 281 against a wall of the cylinder 207 around the bore 207*d* can be prevented by the second bumper 282. Further, the second bumper 282 is adapted to absorb impact force of the second piston 281 during screw driving phase. The abutment position between the second piston 281 and the second bumper 282 is a bottom dead center of the second piston 281.

The lower portion of the second cylinder chamber 207*b* is formed with a vent hole (not shown) in communication with the exhaust port (not shown) formed in the housing 202. A check valve (not shown) is provided at the vent hole to exclusively allow combustion gas to flow from an interior of the second cylinder chamber 207*b* to an exterior thereof. Further, an exhaust cover (not shown) is provided for covering the vent hole.

The combustion chamber frame 212 disposed in the housing 202 has a hollow cylindrical shape having open ends, and is disposed over the cylinder 207. The combustion chamber frame 212 is vertically reciprocally movable relative to the cylinder 207, and has an inner peripheral surface 212A in hermetic contact with the seal portion 207A when the frame 212 is elevated against the biasing force of the spring (not shown). The combustion chamber frame 212 has a lower end portion integrally provided with a link member (not shown) that is connected to the push lever 5.

The cylinder head 227 is positioned above the combustion chamber frame 212, and is fixed to the housing 202. The cylinder head 227 is formed with a fuel passage 227*a* for introducing combustible gas from a gas canister (not shown) into a combustion chamber 221*a*. The cylinder head 227 has a lower portion provided with a seal portion 227A with which an upper inner peripheral surface portion of the combustion chamber frame 212 is in contact. Upon intimate contact with the seal portion 227A with the upper inner peripheral surface portion, the combustion chamber 221*a* is defined. More specifically, by the upward movement of the combustion chamber frame 212, the upper inner peripheral surface portion of the combustion chamber frame 212 is brought into intimate contact with the seal portion 227A, whereupon the combustion chamber 221*a* is defined by an upper surface of the first piston 271, the upper surface of the second piston 281, the upper surface of the cylinder 207, the combustion chamber frame 212, and a lower surface of the cylinder head 227. The combustion chamber 221*a* can be fluid-tightly maintained because of the intimate contact between the seal portion 227A and the upper inner peripheral surface portion of the combustion chamber frame 212, and between the seal portion 207A and the inner peripheral surface 212A of the combustion chamber frame 212.

The fan motor 211 is held by the cylinder head 227 and has a rotation shaft 211A extending in the vertical direction and protruding into the combustion chamber 221*a*. An ignition plug 229 is also held by the cylinder head 227. A head switch (not shown) is provided in the housing 202 to detect an upper stroke end position of the combustion chamber frame 212 as a result of pushing the push lever 5 against the workpiece P. The head switch (not shown) is rendered ON when the push lever 5 is elevated to a predetermined position whereupon rotation of the fan motor 211 will be started.

The fan 210 is fixedly mounted on a lower portion of the rotation shaft 211A, and is exposed to the combustion chamber 221*a*. In a state where the combustion chamber frame 212 is in contact with the cylinder head 227, the rotation of the first fan 210 promotes agitation between air and combustible gas, generates turbulent combustion upon ignition for promoting combustion, and discharges exhaust gas after combustion of the combustible gas out of the combustion chamber 221*a*.

The ignition plug 229 is disposed at the upper region of the combustion chamber 221*a* for igniting combustible gas supplied thereinto.

The head cover 224 is positioned at the upper portion of the housing 202 and is formed with a plurality of air intake ports 224*a*. A fresh air can be introduced into the combustion chamber 221*a* through the intake ports 224*a* by the rotation of the fan 210.

Figure 5A:
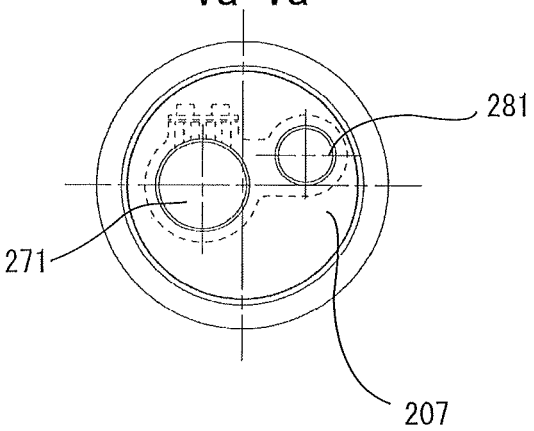
FIG. 5(*a*) is a cross-sectional view taken along the line Va-Va of FIG. 4.
Figure 5B:
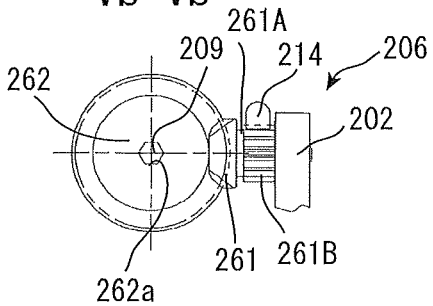

As shown in FIG. 5(*b*), the motion conversion mechanism 206 includes a first bevel gear 261 and a second bevel gear 262. The first bevel gear 261 is rotatably supported to the housing 202, and has a shaft portion 261A where a pinion 261B is formed. The rack 214A of the rod 214 is meshingly engageable with the pinion 261B. Thus, the linear movement of the rod 214 can be converted into a rotational movement of the first bevel gear 261. The first bevel gear 261 is meshingly engaged with the second bevel gear 262 having a rotation shaft extending in perpendicular to the shaft portion 261A. The second bevel gear 262 is rotatably supported to the housing 202. Thus, the rotation of the first bevel gear 261 is transmitted to second bevel gear 262, so that the second bevel gear 262 is rotatable about its axis. The second bevel gear 262 has a radially center portion formed with a hexagonal bore 262*a* through which the bit 209 extends. By the vertical movement of the rod 214, the pinion 261B is rotated about its axis, and therefore, the first bevel gear 261 and the second bevel gear 262 are rotated about their axis. Because of the engagement with the bit 209 and the hexagonal bore 262*a*, the bit 209 is rotated about its axis coaxially with the rotation of the second bevel gear 262.

Next, operation of the fastener driving tool 201 will be described. Prior to the fastener driving operation, the upper end of the combustion chamber frame 212 is positioned away from the cylinder head 227 as shown in FIG. 4, since the combustion chamber frame 212 is connected to the push lever 5 through the link member (not shown). In this case, a first vent hole 221*b* is provided between the upper end portion of the combustion chamber frame 212 and the cylinder head 227. Further, the first and second pistons 271, 281 are positioned at their top dead center positions. Further, in a state shown in FIG. 4, a second vent hole (not shown) is provided between the seal portion 207A and the inner peripheral surface 212A of the combustion chamber frame 212.

When the user grips the handle 3 and pushes the push lever 5 against the workpiece P, the combustion chamber frame 212 is moved upward through the link member (not shown). By the upward movement, the upper end of the combustion chamber frame 212 is brought into abutment with the cylinder head 227 so as to hermetically provide the combustion chamber 221*a*.

Further, in accordance with the movement of the push lever 5, the gas canister (not shown) is tilted toward the cylinder head 227, so that combustible gas accumulated in the gas canister will be ejected once into the combustion chamber 221*a* through the fuel passage 227*a*.

When the combustion chamber frames 212 reaches its stroke end in accordance with the movement of the push lever 5, the head switch (not shown) is turned ON to start electrical power supply to the fan motor 211, thereby starting rotation of the fan 210. Accordingly, combustible gas introduced into the combustion chambers 221*a* can be agitatingly mixed with fresh air.

Then, when the trigger 36 is turned ON, the ignition plug 229 in the combustion chamber 221*a* is ignited, thereby igniting, combusting, and exploding the air/fuel mixture. Because of the combustion and explosion, the first piston 271 along with the bit 209 and the second piston 281 along with the rod 214 are moved downward. As shown in FIG. 4, since the rack 214A is positioned away from the pinion 261B by a predetermined length when the second piston 281 is at its top dead center, an initial downward movement of the rod 214 does not provide meshing engagement between the rack 214A and the pinion 261B, but this engagement is started after elapse of a predetermined time period from the start of the downward movement of the second piston 281. More specifically, the rack 214A is formed at a proper position of the rod 214 such that meshing engagement between the rack 214A and the pinion 281 starts after the screw 41 is brought into abutment with the workpiece P. That is, rotation force is transmitted to the bit 209 by the motion conversion mechanism 206 after the screw 41 is brought into abutment with the workpiece P. As a result, the screw 41 can be stably driven into the workpiece P.

The combustion gas remaining in the cylinder chamber 207*a* and the combustion chamber 221*a* has high temperature, and therefore, the combustion heat will be absorbed thereinto. Thus, temperature of the cylinder 207 and the combustion chamber frame 212 will be increased. The heat is then released to the atmosphere through the outer surfaces thereof.

Because of the heat absorption into the cylinder 207 and the combustion chamber frame 212, combustion gas is promptly cooled to decrease a volume thereof. Accordingly, pressure in the upper chamber of the first piston 271 will be decreased to become a pressure not more than the atmospheric pressure to cause a thermal vacuum. As a result, the first piston 271 can be returned to its initial top dead center position. The same is true with respect to the second piston 281, so that the second piston 281 is returned to its top dead center position because of the thermal vacuum.

Then the trigger is rendered OFF, and the user lifts the fastener driving tool 201 in its entirety to separate the push lever 5 from the surface of the workpiece P. As a result, the combustion chamber frame 212 is returned to its position shown in FIG. 4 because of the biasing force of the spring (not shown). Then, the head switch is rendered OFF at a timing elapsing from a predetermined time period. However, the fan 210 continues rotation for a predetermined period of time. Because of the rotation of the fan 210, air flow can be generated. That is, fresh air is introduced from the air intake ports 224*a* into the combustion chamber 221*a* through the first vent hole 221*b*, and the air and the residual combustion gas can be discharged through the exhaust port (not shown) of the housing 202. Accordingly, scavenging can be performed with respect to the combustion chamber 221*a*. Then, rotation of the fan 210 is stopped to provide an initial stationary phase. Then, the above-described operation will be repeatedly performed for successively driving the screw 41 into the workpiece P.

As described above, displacement of the first and second pistons 271, 281 occurs by the expansion of the combustion gas in the combustion chamber 221*a*. The displacement of the first piston 271 provides a linear movement of the bit 209, and displacement of the second piston 281 provides rotational movement of the bit 209. Thus, the screw 41 can be driven into the workpiece P with its linear movement and rotation. Further, a hose for supplying a compressed air in a pneumatically operated screw driver or an electric cord required in an electrically powered screw driver can be dispensed with, thereby enhancing portability and operability.

Further, meshing engagement between the rack 214A and the pinion 261B starts after elapse of predetermined time period from the start of the downward motion of the rod 214. Therefore, the rotation of the bit 209 starts for rotationally fastening the screw 41 after the linear driving of the screw 41 into the workpiece P. Consequently, impact exerted on the workpiece P from the screw 41 can be reduced in comparison with a case where the linear driving and rotational driving are started simultaneously. Thus, disadvantageous displacement of the workpiece P at the time of screw driving can be restrained, and sharpshooting of the screw 41 relative to the workpiece P can be realized.

Further, a single combustion chamber 221*a* is provided, and the first and second pistons 271, 281 are provided in the single cylinder 207. Therefore, compact and light-weight fastener driving tool can be provided. Furthermore, the single combustion chamber 221*a* can reduce amount of the combustible gas in comparison with a case where two combustion chambers are provided. Therefore, lower running cost can result.

A fastener driving tool 301 according to a third embodiment of the present invention will be described with reference to FIGS. 6 to 9, wherein like parts and components are designated by the same reference numerals as those shown in FIG. 4. The fastener driving tool 301 includes a housing 202, a handle 3, a magazine 4, a push lever 5, and a motion conversion mechanism 206.

Figure 7:
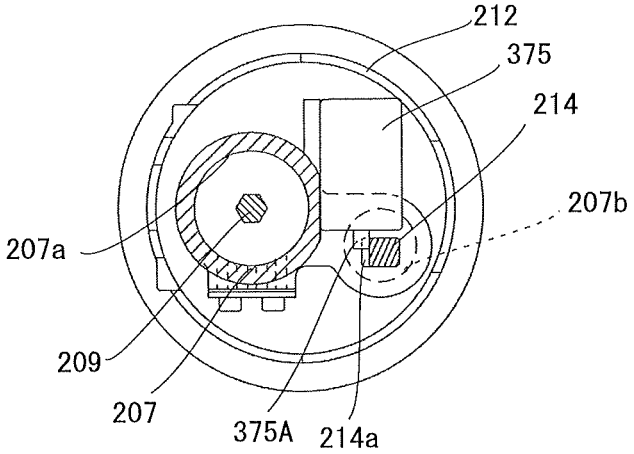
FIG. 7 is a cross-sectional view taken along the line VII-VII of FIG. 6.
Figure 8:
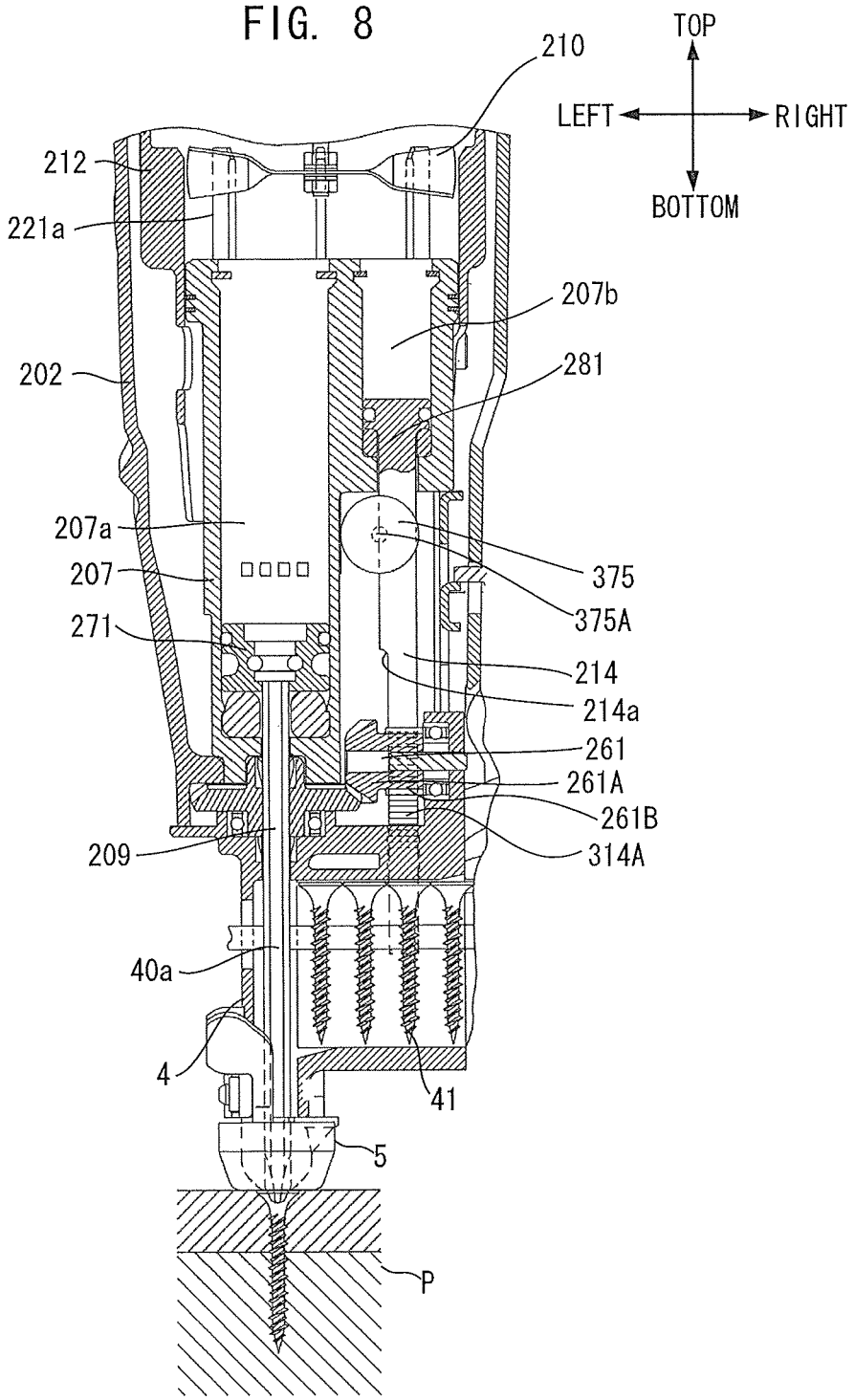
FIG. 8 is a cross-sectional view particularly showing a solenoid and components ambient thereto in a state of completion of screw driving operation in the fastener driving tool according to the third embodiment.

A solenoid 375 functioning as an actuator is provided at a position below the second cylinder chamber 207*b*. The solenoid 375 has a protrudable and retractable plunger 375A. As shown in FIGS. 7 and 8, the plunger 375A is positioned in alignment with a locus of the vertically movable rod 214. When the plunger 375A maintains its protruding state, the plunger 375A is engaged with the notched portion 214*a* of the rod 214 to prevent the rod 214 from moving toward its bottom dead center. On the other hand, the plunger 375A is spaced away from the locus of the rod 214 when the plunger 375A maintains its retracted state.

The rod 214 has a lower portion formed with a rack 314A having a predetermined length longer than the rack 214A of the second embodiment, i.e. the rack 314A and pinion 216B of the motion conversion mechanism 206 are engaged with each other while the rod 214 is at its top dead center.

A control device 334 is provided at a rear side of the magazine 4. The control device 334 is provided with a timer, and is electrically connected to the solenoid 375, the trigger 36 and the head switch (not shown). The solenoid 375 is operated after elapse of a predetermined time period from ON timing of these switches.

A gas canister retaining portion 323 is positioned at one side of the housing 202 and extends in a vertical direction for retaining therein a gas canister 323A. The gas canister 323A accommodates therein the combustible gas and is configured to eject the combustible gas by a predetermined amount. The gas canister 323A is tiltable toward the cylinder head 227 in accordance with the movement of the push lever 5, and has a gas ejecting portion (not shown) in fluid communication with the fuel passage 227*a*. Accordingly, the combustible gas can be ejected into the combustion chambers 221*a* through the fuel passage 227*a*.

Figure 6:
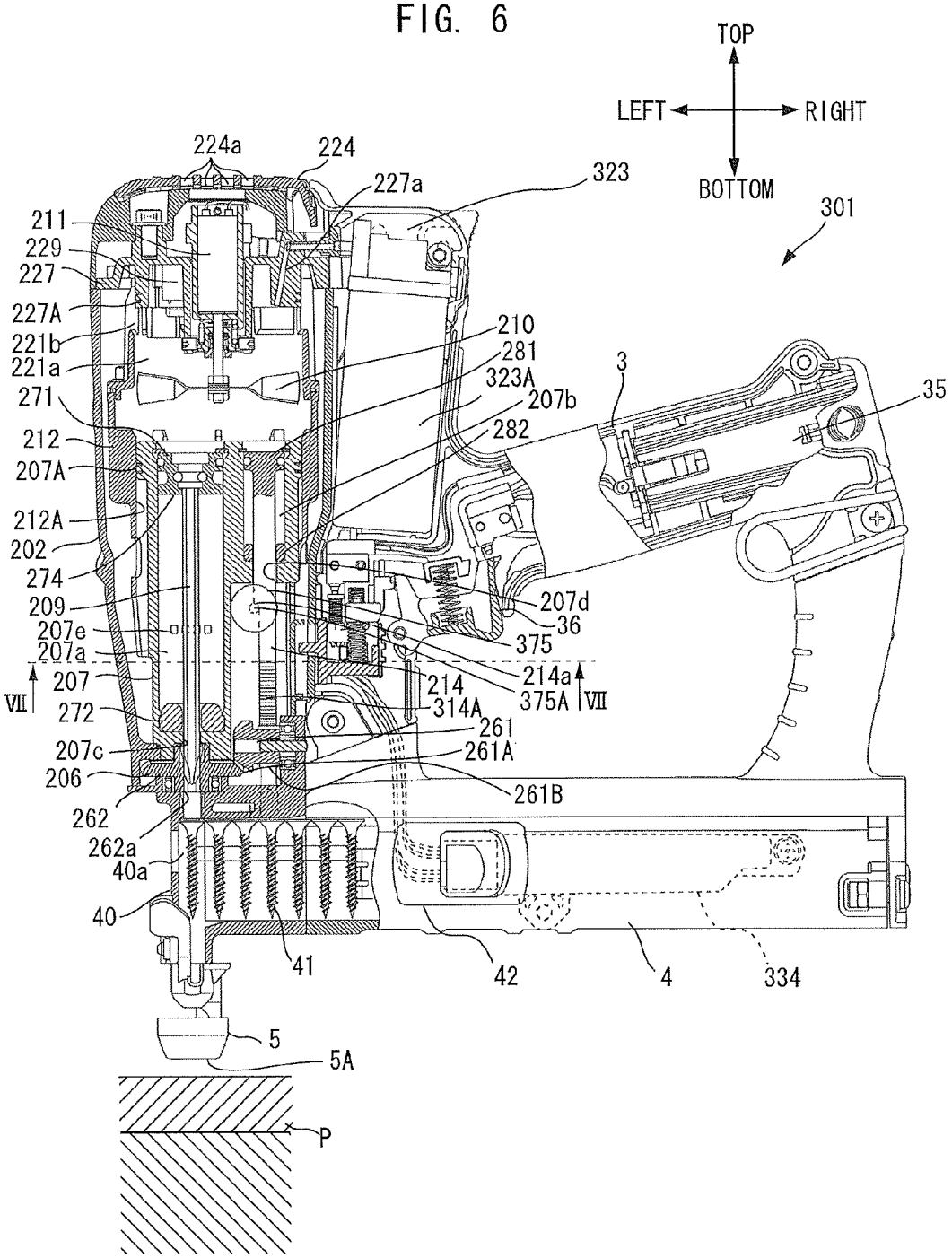
FIG. 6 is a cross-sectional view of a fastener driving tool according to a third embodiment of the present invention.
Figure 9:
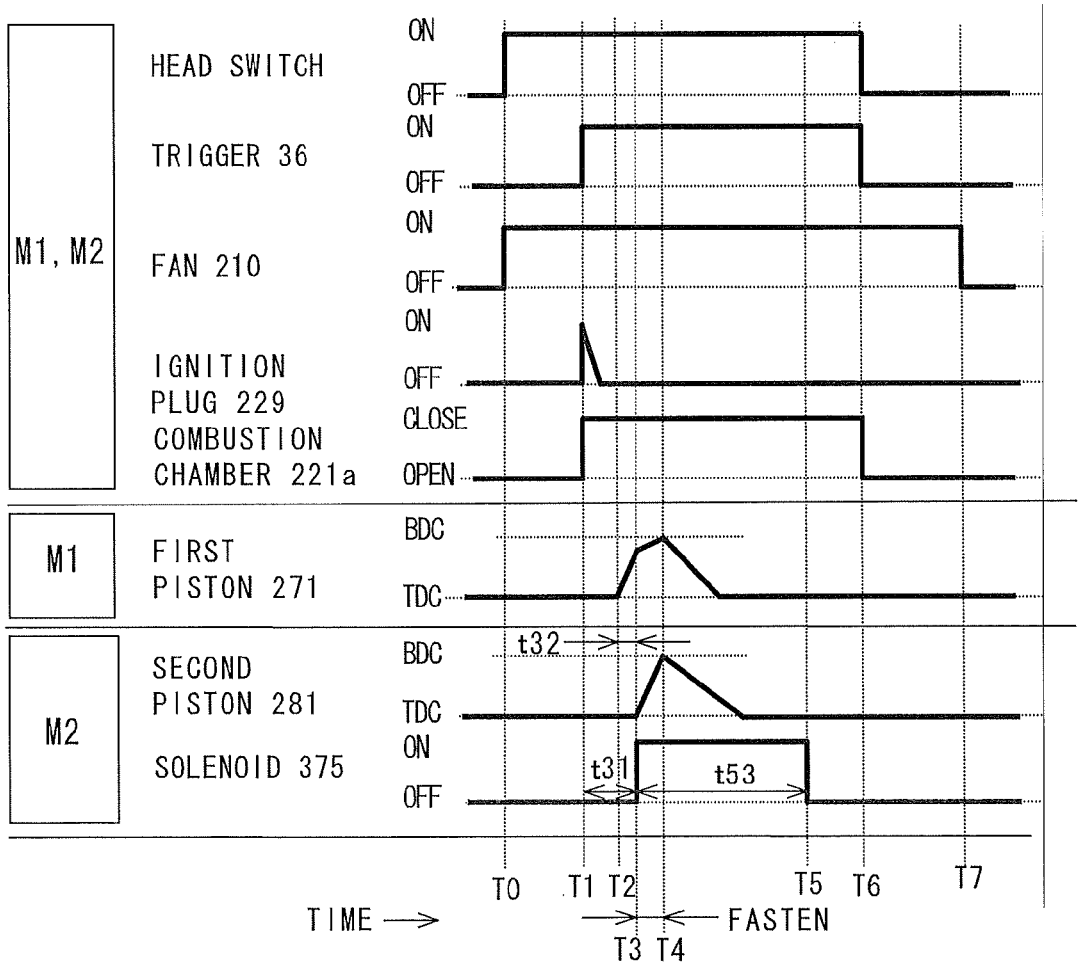
FIG. 9 is a time chart illustrating operation timing and period of respective components in the fastener driving tool according to the third embodiment.

Next, operation of the fastener driving tool 301 will be described with reference to a time chart shown in FIG. 9. In FIG. 9, M1 means the linear driving mechanism and M2 means the rotational driving mechanism. Further, TDC, BDC represent top dead center and bottom dead center, respectively. Prior to the fastener driving operation, the upper end of the combustion chamber frame 212 is positioned away from the cylinder head 227 as shown in FIG. 6, since the combustion chamber frame 212 is connected to the push lever 5 through the link member (not shown). In this case, the first vent hole 221*b* is provided between the upper end portion of the combustion chamber frame 212 and the cylinder head 227. Further, the first and second pistons 271, 281 are positioned at their top dead center positions. The push lever 5 are urged downward by the spring (not shown) to protrude downward from the nose portion 40. Further, the plunger 375A is engaged with the notched portion 214*a* of the rod 214, so that the second piston 281 cannot be moved toward its bottom dead center.

Then, by pushing the push lever 5 against the workpiece P while holding the handle 3, the combustion chamber frame 212 is moved upward through the link member (not shown) linked between the push lever 5 and the combustion chamber frame 212 in order to turn the head switch (not shown) ON at a timing T=T0. Further, upon abutment of the upper end of the combustion chamber frame 212 onto the cylinder head 227, sealed combustion chamber 221*a* can be provided. Further, the gas canister 323A tilts toward the cylinder head 227 in accordance with the movement of the push lever 5, so that combustible gas is injected once into the combustion chamber 221*a* through the fuel passage 227*a*.

Upon turning ON the head switch (not shown), electrical current will be supplied to the fan motor 211 to start rotation of the fan 210. Therefore, the injected combustible gas will be mixed with air in the combustion chamber 221*a* to produce gas/fuel mixture.

Then, at a timing T=T1, upon turning ON the trigger 36, the ignition plug 229 in the combustion chamber 221*a* will be ignited to cause combustion and explosion of the air/fuel mixture. Therefore, movement of the first piston 271 toward its bottom dead center along with the bit 209 is started at a timing T=T2. On the other hand, movement of the second piston 281 toward its bottom dead center is prevented at the timing T=T2 because of the protruding position of the solenoid 375.

Electrical current supply to the solenoid 375 is started at a timing T=T3 by way of the control device 334. This current supply timing occurs after elapse of predetermined time period (t31) starting from ON timing of the trigger 36 while the head switch (not shown) is rendered ON. By the electrical power supply, the plunger 375A is retracted from the locus of the rod 214. This predetermined time period t31 is experimentally computed by the aggregate time period of (T2−T1) and (t32), where (T2−T1) is a period starting from ON timing of the ignition plug 229 and ending at a start timing to start movement of the first piston 271, and (t32) is a period starting from the start timing to start movement of the first piston 271 and ending at a timing where a tip end of the screw 41 is brought into abutment with the workpiece P after the bit 209 abuts the head of the screw 41 positioned in the injection passage 40*a* and the bit 209 moves the screw 41 downward. In other words, the period (t32) is a period required for moving the first piston 271 from its top dead center to a position near the bottom dead center.

By the retraction of the plunger 375A out of the locus of the rod 214, the second piston 281 and the rod 214 can start moving toward the bottom dead center. Because the rack 314A and the pinion 261B of the motion conversion mechanism 206 are engaged with each other while the rod 214 is at its top dead center, operation of the motion conversion mechanism 6 can be started concurrently with the start of movement of the second piston 281 and the rod 214 toward the bottom dead center.

With such operation timing of the second piston 281, the operation of the motion conversion mechanism 206 can be started, i.e., rotation of the bit 209 can be started concurrently with the abutment timing of the tip end of the screw 41 onto the workpiece P. In other words, rotation of the bit 209 does not occur until the screw 41 abuts against the workpiece P, but the rotation of the bit 209 is started upon abutment of the screw 41 onto the workpiece P.

Rotation amount (rotation number) of the motion conversion mechanism 206 is based on displacement length of the rack 314A relative to the pinion 261B in accordance with the movement of the second piston 281 from its top dead center to the bottom dead center. The rotation amount is finite because the displacement is finite. In the present embodiment, rotation start timing of the motion conversion mechanism 206, i.e., displacement start timing of the second piston 281, is coincident with the abutment timing of the screw 41 against the workpiece P. Consequently, displacement of the second piston 281 can be efficiently converted into sufficient amount of rotation required for fastening the screw 41 into the workpiece P. Accordingly, the screw 41 can be sufficiently driven into the workpiece P until the head of the screw 41 reaches the surface of the workpiece P.

The combustion gas remaining in the cylinder chamber 207*a* and the combustion chamber 221*a* has high temperature, and therefore, the combustion heat will be absorbed thereinto. Thus, temperature of the cylinder 207 and the combustion chamber frame 212 will be increased. The heat is then released to the atmosphere through the outer surfaces thereof.

Because of the heat absorption into the cylinder 207 and the combustion chamber frame 212, combustion gas in the first cylinder chamber 207*a* is promptly cooled to decrease a volume thereof. Accordingly, pressure in the upper chamber of the first piston 271 will be decreased to become a pressure not more than the atmospheric pressure to cause a thermal vacuum. As a result, the first piston 271 can be returned to its initial top dead center position. The same is true with respect to the second piston 281, so that the second piston 281 is returned to its top dead center position because of the thermal vacuum.

Then, after elapse of time period of t53 from the retraction timing of the plunger 375A, electric power supply to the solenoid 375 is shut off at a timing T5 so as to project the plunger 375A. Time periods for returning the first piston 271 and the second piston 281 to their original positions are experimentally obtained, and the time period t53 is set longer than a time period starting from retraction timing of the plunger 375A and ending at the timing at which the second piston 281 reaches its original position. With this setting of the plunger 375A, the plunger 375A can surely be engaged again with the notched portion 214*a* of the rod 214 returned to this original position, to again prevent the second piston 281 from moving toward its bottom dead center.

Then the trigger 36 is rendered OFF at a timing T6, and the user lifts the fastener driving tool 301 in its entirety to separate the push lever 5 from the surface of the workpiece P. As a result, the push lever 5 and the combustion chamber frame 212 are returned to their positions shown in FIG. 6 because of the biasing force of the spring (not shown).

Then, the fan 210 is rendered OFF at a timing T7 elapsing from a predetermined time period from the timing T6. That is, the fan 210 continues rotation for a predetermined period of time by a timing T7. Because of the rotation of the fan 210, air flow can be generated in the combustion chamber 221*a*. That is, fresh air is introduced from the first vent hole 221*b* at a position above the combustion chamber frame 212 into the combustion chamber 221*a* through the air intake ports 224*a*, and the air and the residual combustion gas can be discharged through the exhaust port (not shown) of the housing 202. Accordingly, scavenging can be performed with respect to the combustion chamber 221*a*. Then, rotation of the fan 210 is stopped at a timing T7 to provide an initial stationary phase. Further, a new screw 41 is automatically supplied into the injection passage 40*a* by the feeder 42 after the bit 209 is moved toward its top dead center. Then, the above described operation can be performed repeatedly to successively drive the screws 41 into the workpiece P.

In the above-described fastener driving tool 301, driving sources different from each other are not required, but the combustion pressure is used as a single driving source for rotating the fastener as well as for linearly driving the fastener. Therefore, inadvertent increase in weight of the fastener driving tool 301 can be restrained. Further, since the operation start timing of the second piston 281 is later than the operation start timing of the first piston 271, rotation of the screw 41 will be started after the screw 41 has been pressed against the workpiece P by the first piston 271. Accordingly the screw 41 can be sufficiently screwed into the workpiece P, to enhance workability and to avoid any disadvantage of insufficient screwing, such as floating a screw head from the surface of the workpiece P. Since the screw 41 can be sufficiently screwed into the workpiece P, labor of positively pressing the fastener driving tool 301 against the workpiece P can be reduced or can be dispensed with, thereby cutting back the workload. Further, since the first and second pistons 271 and 281 are driven with the single combustion chamber 221*a*, mechanical parts and components can be reduced to reduce the weight of the fastener driving tool 301.

A fastener driving tool 401 according to a fourth embodiment of the invention will be described with reference to FIGS. 10 and 11. The fastener driving tool 401 according to the fourth embodiment is the same as that of the third embodiment except the formation of a hole 407*a* and provision of a stop member 476 and a spring 477.

Figure 10:
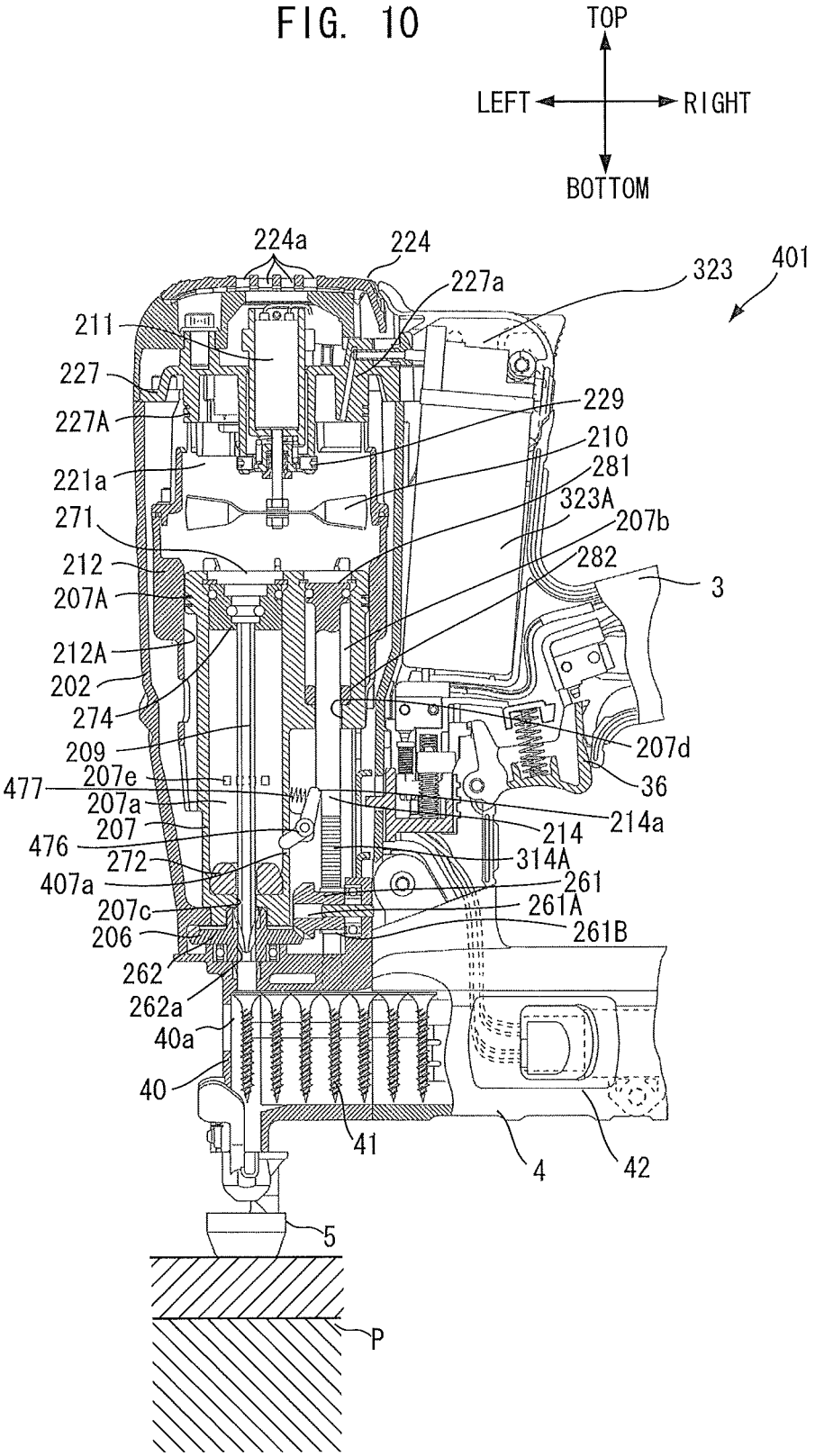
FIG. 10 is a cross-sectional view of a fastener driving tool according to a fourth embodiment of the present invention.
Figure 11:
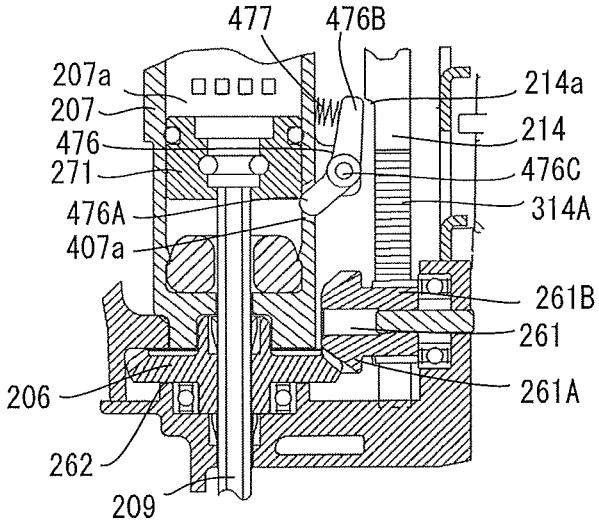
FIG. 11 is a cross-sectional view particularly showing a stop member and components ambient thereto in a state of completion of screw driving operation in the fastener driving tool according to the fourth embodiment.

A wall of the cylinder 207 defining the first cylinder chamber 207*a* is formed with a hole 407*a* open toward a space below the second cylinder chamber 207*b* as shown in FIGS. 10 and 11. Further, the hole 407*a* is positioned to overlap with the first piston 271 when the first piston 271 is moved downward to a position near the bottom dead center as shown in FIG. 11. Furthermore, the hole 407*a* is positioned lower than a seal member assembled over the first piston 271 for sliding contact with the inner peripheral surface of the first cylinder 207*a* when the first piston 271 is positioned at its bottom dead center.

The stop member 476 has a pivot shaft portion 476C, a first arm 476A and a second arm 476B. The pivot shaft portion 476C is pivotally movably supported to the first cylinder 207 and extending in a direction perpendicular to the vertical direction. The first arm 476A extends from the pivot shaft portion 476C and has a free end portion insertable into the hole 407*a*. A distal end of the first arm 476A is protrudable into the first cylinder chamber 207*a* from an inner peripheral surface of the cylinder 207. The second arm 476B extends from the pivot shaft portion 476C and has a free end portion positioned in alignment with the locus of the rod 214 to be engagable with the notched portion 214*a* when the first arm 476A is inserted into the hole 407*a*. "Protruding position" of the stop member 476 means that the free end portion of the first arm 476A protrudes into the first cylinder chamber 207*a*, and the second arm 476B is positioned engageable with the notched portion 214*a* as shown in FIG. 10. "Retracting position" of the stop member 476 means that the first arm 476A is retracted from the first cylinder chamber 207*a* and the second arm 476B is retracted from the locus of the rod 214 as a result of pivot movement of the stop member 476 about the pivot shaft portion 476C in a counterclockwise direction in FIG. 11.

The spring 477 is interposed between the stop member 476 and the cylinder 207 for biasing the stop member 476 toward the protruding position.

Next operation of the fastener driving tool 401 will be described. In a non-operational phase shown in FIG. 10, the stop member 476 is at its protruding position. Then, upon pulling the trigger 36 while pressing the push lever 5 against the workpiece P, combustion occurs in the combustion chamber 221*a*. The first piston 271 starts to move toward its bottom dead center concurrently with the start of the combustion, since downward movement of the first piston 271 is not restrained. On the other hand, downward movement of the second piston 281 is restrained because of the engagement of the second arm 476B with the notched portion 214*a*. Therefore, the second piston 281 maintains its non-operational phase. When the first piston 271 is moved downward toward its bottom dead center, the first piston 271 is brought into abutment with the free end portion of the first arm 476A to push the first arm 476A in a direction retracting from the first cylinder chamber 207*a*, thereby moving the stop member 476 to its retracting position. Thus, the second arm 476B is disengaged from the notched portion 214*a* to allow the second piston 281 to move toward its bottom dead center.

In the fourth embodiment, operation of the second piston 281 is started to start the operation of the rack 314A when the first piston 271 is moved downward to the position near the bottom dead center, i.e., when the tip end of the screw 41 is brought into abutment with the surface of the workpiece P after the bit 209 pushes down the screw 41. Therefore, the movement of the second piston 281 can be effectively converted into the rotational movement of the bit 209 at a desirable rotation start timing thereof.

According to the fourth embodiment, motion of the second piston 281 is controlled by the movement of the first piston 271. Therefore, the movement of the second piston 281 can surely follow the movement of the first piston 271. Further, no electrical arrangement is required for the movement of the second piston 281, thereby reducing a capacity of the battery, to thus reduce a weight of the fastener driving tool 401.

Figure 12:
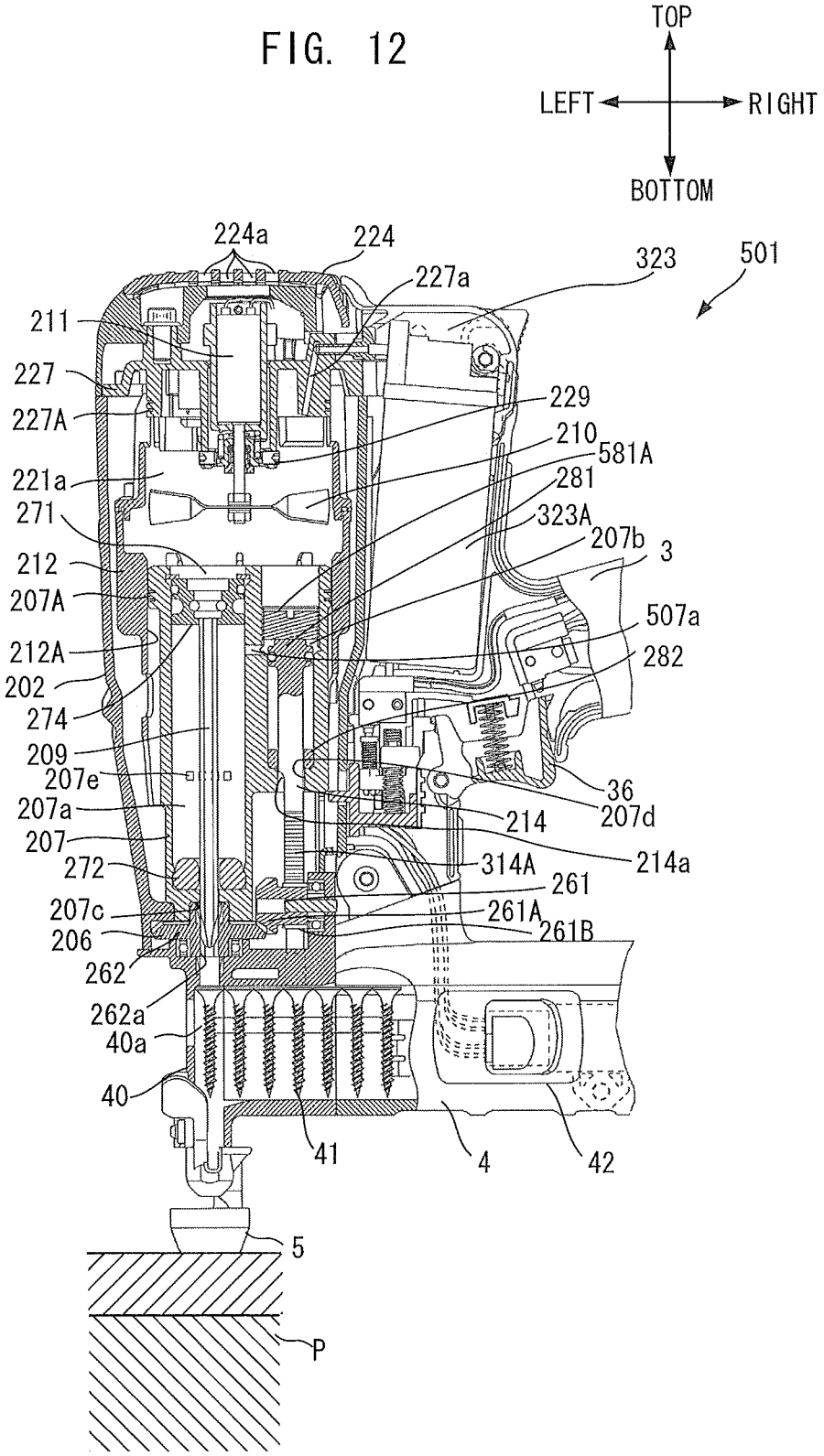
FIG. 12 is a cross-sectional view of a fastener driving tool according to a fifth embodiment of the present invention.
Figure 13:
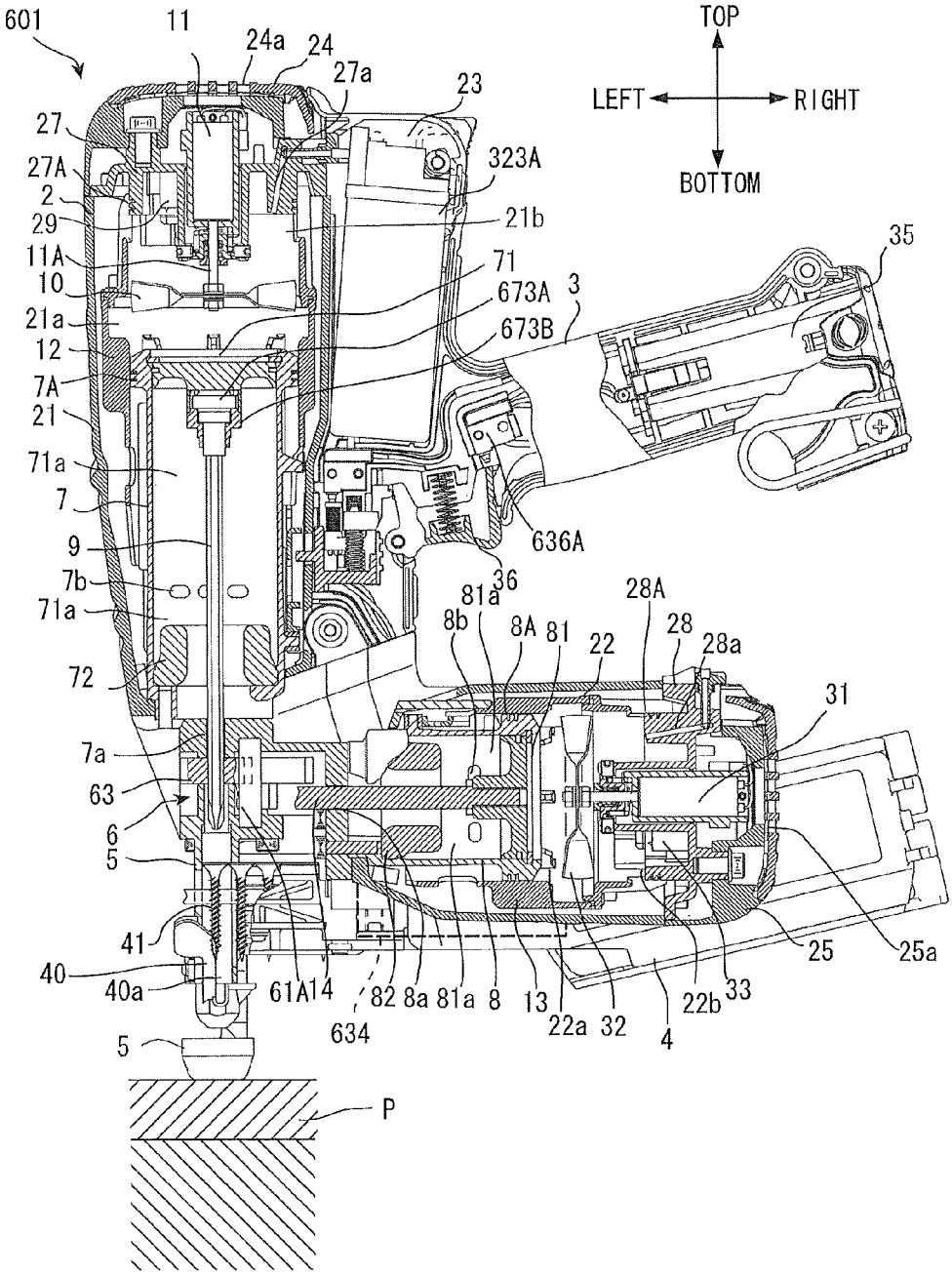
FIG. 13 is a cross-sectional view of a fastener driving tool prior to fastener driving phase according to a sixth embodiment of the present invention.

Next, a fastener driving tool 501 according to a fifth embodiment of the invention will be described with reference to FIG. 12. The fastener driving tool 501 according to the fifth embodiment is the same as that of the third embodiment except for a configuration of the cylinder 207.

A partition wall 581A is provided at an upper portion of the second cylinder chamber 207*b* to avoid direct fluid communication between the combustion chamber 221*a* and the second cylinder chamber 207*b*. A fluid passage 507*a* is formed in the cylinder wall to allow fluid communication between the first and second cylinder chambers 207*a* and 207*b*.

The fluid passage 507*a* has a first opening open to the first cylinder chamber 207*a* and a second opening open to the second cylinder chamber 207*b*. The first opening is so positioned that the first, opening is initially communicated with a space in the first cylinder chamber 207*a* but above the first piston 271 when the first piston 271 is moved to a predetermined position toward the bottom dead center from its top dead center, i.e., the first opening is positioned at an intermediate position between the top dead center and the bottom dead center of the first piston 271, but is slightly displaced toward the top dead center. As described in connection with the third embodiment, the bit 209 pushes the screw 41 against the workpiece P after the first piston 271 has been moved to the position near the bottom dead center. To this effect, a predetermined period of time is required from a timing at which the first piston 271 moves past the first opening to a timing at which the bit 209 starts to push the screw 41 against the workpiece P. Further, the second opening of the fluid passage 507*a* is positioned to allow continuous fluid communication between a space of the first cylinder chamber 207*a* and a space of the second cylinder chamber 207*b*.

Next operation of the fastener driving tool 501 will be described. In a non-operational phase shown in FIG. 12, the first and second pistons 271 and 281 are their top dead center positions. Then, upon pulling the trigger 36 while pressing the push lever 5 against the workpiece P, combustion occurs in the combustion chamber 221*a*. The first piston 271 starts to move toward its bottom dead center concurrently with the start of the combustion, since downward movement of the first piston 271 is not restrained. On the other hand, the second piston 281 remains unmoved at the top dead center since direct communication between the combustion chamber 221*a* and the space above the second piston 281 is shut off by the partition wall 581A.

When the first piston 271 is moved to the first opening of the fluid passage 507*a* to communicate the fluid passage 507*a* with the space of the first cylinder chamber 207*a* but above the first piston 271, the space of the second cylinder chamber 207*b* but above the second piston 281 is brought into fluid communication with the combustion chamber 221*a* through the space of the first cylinder chamber 207*a* above the first piston 271 and the fluid passage 507*a*. Accordingly, a pressure in the space of the second cylinder chamber 207*b* above the second piston 281 becomes higher than a pressure in a space of the second cylinder chamber 207*b* below the second piston 281. Consequently, the movement of the second piston 281 toward its bottom dead center is started.

The second cylinder chamber 207*b* is communicated with the combustion chamber 221*a* and the space of the first cylinder chamber 207*a* above the first piston 271 only through the fluid passage 507*a*. In this case, the fluid passage 507*a* must have a small inner diameter due to structural reason, so that reduced amount of fluid must pass through the fluid passage 507*a*. Accordingly, rapid pressure increase within the space of the second cylinder chamber 207*b* above the second piston 281 does not occur, but the increase may be moderate increase. Consequently, a timing for starting movement of the second piston 281 toward its bottom dead center is retarded or delayed.

However, a predetermined time period is required from the timing at which the fluid passage 507*a* is brought into communication with the combustion chamber 221*a* (at a timing where the first piston 271 has just moved past the first opening) to a timing at which the bit 209 starts to push the screw 41 against the workpiece P (at a timing where the first piston 271 reaches a position near the bottom dead center). Therefore, the pressure increase in the space of the second cylinder chamber 207*b* above the second piston 281 can be attained during the predetermined time period. Consequently, by the time the first piston 271 has reached the position near the bottom dead center, the downward movement of the second piston 281 toward the bottom dead center can be started. Thus, the screw rotation can be started by way of the rack 314A and the motion conversion mechanism 206 at a proper timing.

According to the fifth embodiment, movement of the second piston 281 is controlled by the movement of the first piston 271. Therefore, the movement of the second piston 281 can surely follow the movement of the first piston 271. Further, control to the movement of the second piston 281 can be achieved by the control to the pressure in the cylinder chamber 207*b*. Therefore, specific mechanical components are not required for controlling the movement of the second piston 281 to reduce a weight of the fastener driving tool 501.

Next, a fastener driving tool 601 according to a sixth embodiment of the invention will be described with reference to FIGS. 13 to 18, wherein like parts and components are designated by the same reference numerals as those shown in FIGS. 1 through 3. The fastener driving tool 601 according to the sixth embodiment is substantially the same as the fastener driving tool 1 of the first embodiment. Thus, description is given to a configuration different from that of the first embodiment.

The first piston 71 has a boss portion provided on a bottom surface thereof and protruding downward. The boss portion is provided with a pin 673A extending downwardly. A sleeve 673B having a hollow cylindrical shape is incorporated in the pin 673A. The base end (top end) of the bit 9 is inserted into an inner hollow space of the sleeve 673 for rotatably supporting the bit 9.

A head switch 637A (FIG. 14) is provided in the first housing 21 to detect an upper stroke end position of the first combustion chamber frame 12 as a result of pushing the push lever 5 against the workpiece P. The head switch 637A is rendered ON when the push lever 5 is elevated to a predetermined position whereupon rotation of the first fan motor 11 and the second fan motor 31 will be started.

The second combustion chamber frame 13 is movable in a rightward/leftward direction relative to the second cylinder 8. The second combustion chamber frame 13 has a longitudinally intermediate portion to which one end of a second link member (not shown but corresponding to the second link member 17 of the first embodiment) is pivotally movably connected. Thus, similarly to the first embodiment, the second combustion chamber frame 13 is moved rightward and leftward in response to upward movement and downward movement of the push lever 5, respectively.

Figure 14:
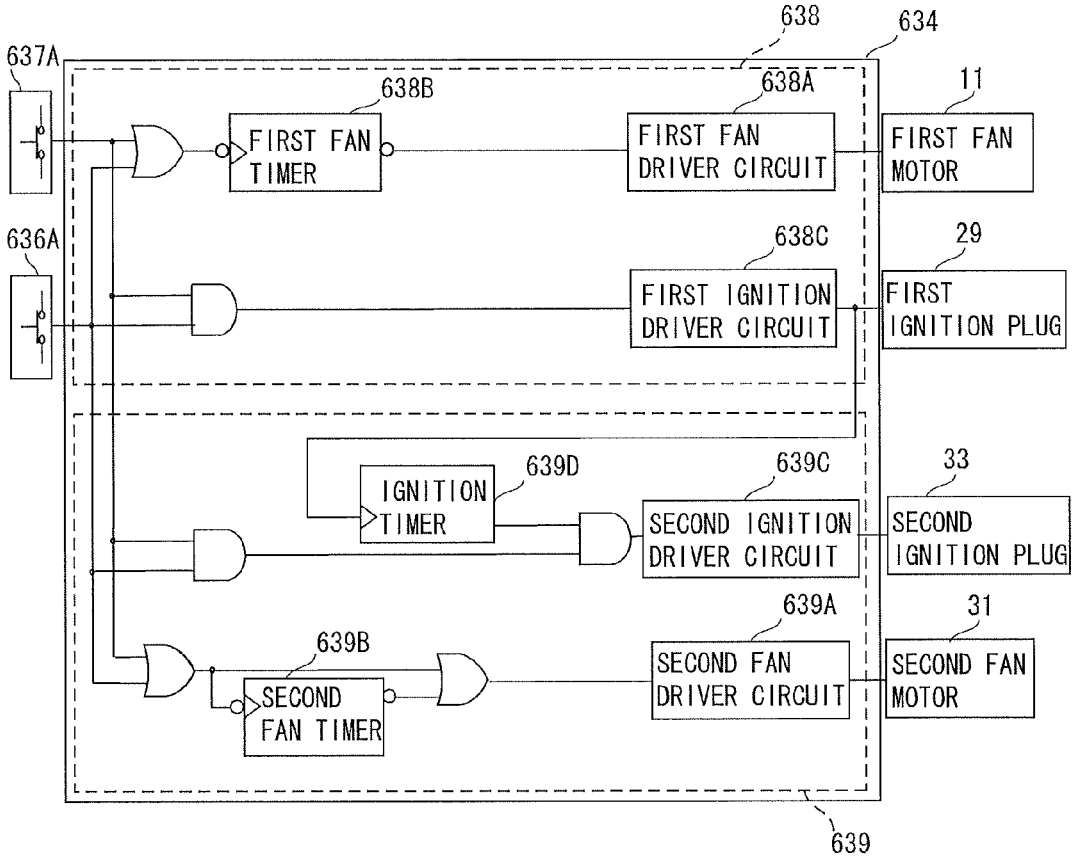
FIG. 14 is a block diagram showing a control device in the fastener driving tool according to the sixth embodiment.

A control device 634 is provided inside the magazine 4. As shown in FIG. 14, the control device 634 is connected to a trigger switch 636A provided in the handle 3, the head switch 637A, the first ignition plug 29, the second ignition plug 33, the first fan motor 11 and the second fan motor 31. The control device 634 includes a linear driving controller 638 for controlling movement of the first piston 71, and a rotational driving controller 639 for controlling movement of the second piston 81. The linear driving controller 638 includes a first fan driver circuit 638A, a first fan timer 638B, and a first ignition driver circuit 638C. The rotational driving controller 639 includes a second fan driver circuit 639A, a second fan timer 639B, a second ignition driver circuit 639C and an ignition timer 639D.

The first fan driver circuit 638A is connected to the first fan motor 11 for applying a driving electric power to the first fan motor 11 in response to a signal from the first fan timer 638B. A signal from the head switch 637A and a signal from the trigger switch 636A are to be applied to the first fan timer 638B. The first fan timer 638B is configured to start and continue transmission of a drive signal to the first fan driver circuit 638A for a predetermined period of time in response to a timing where no signals from the head switch 637A and the trigger switch 636A are transmitted to the first fan timer 638B. The first ignition driver circuit 638C is configured to output a drive signal to the first ignition plug 29 upon reception of signals from both the head switch 637A and the trigger switch 636A.

The second fan driver circuit 639A is connected to the second fan motor 31, and is configured to transmit a drive signal to the second fan motor 31 in response to a signal from the second fan timer 639B or in response to at least one of a signals from one of the head switch 637A and the trigger switch 636A. A signal from the head switch 637A and a signal from the trigger switch 636A are to be applied to the second fan timer 639B. The second fan timer 639B is configured to continue transmission of a drive signal to the second fan driver circuit 639A for a predetermined period of time in response to a timing where no signals from the head switch 637A and the trigger switch 636A are transmitted to the second fan timer 639B. The second ignition driver circuit 639C is configured to output a drive signal to the second ignition plug 33 upon reception of signals from the ignition timer 639D, the head switch 637A, and the trigger switch 636A. The ignition timer 639D is adapted to transmit the signal to the second ignition driver circuit 639C after elapse of a predetermined time period t13 (about 15 ms) counting from a reception timing of the signal transmitted from the first ignition driver circuit 638C.

Next a fastener driving operation of the sixth embodiment will be described with reference to a block diagram shown in FIG. 14, a time chart shown in FIG. 17 and a graph shown in FIG. 18. In a sate shown in FIG. 13, the push lever 5 and the trigger 36 are not operated, and therefore, the head switch 637A, the trigger switch 636A, the first fan motor 11, the first ignition plug 29, the second fan motor 31, and the second ignition plug 33 are all rendered OFF. Further, the first and second combustion chambers 21*a*, 22*a* are opened and the first and second pistons 71, 81 are at their top dead centers.

Figure 15:
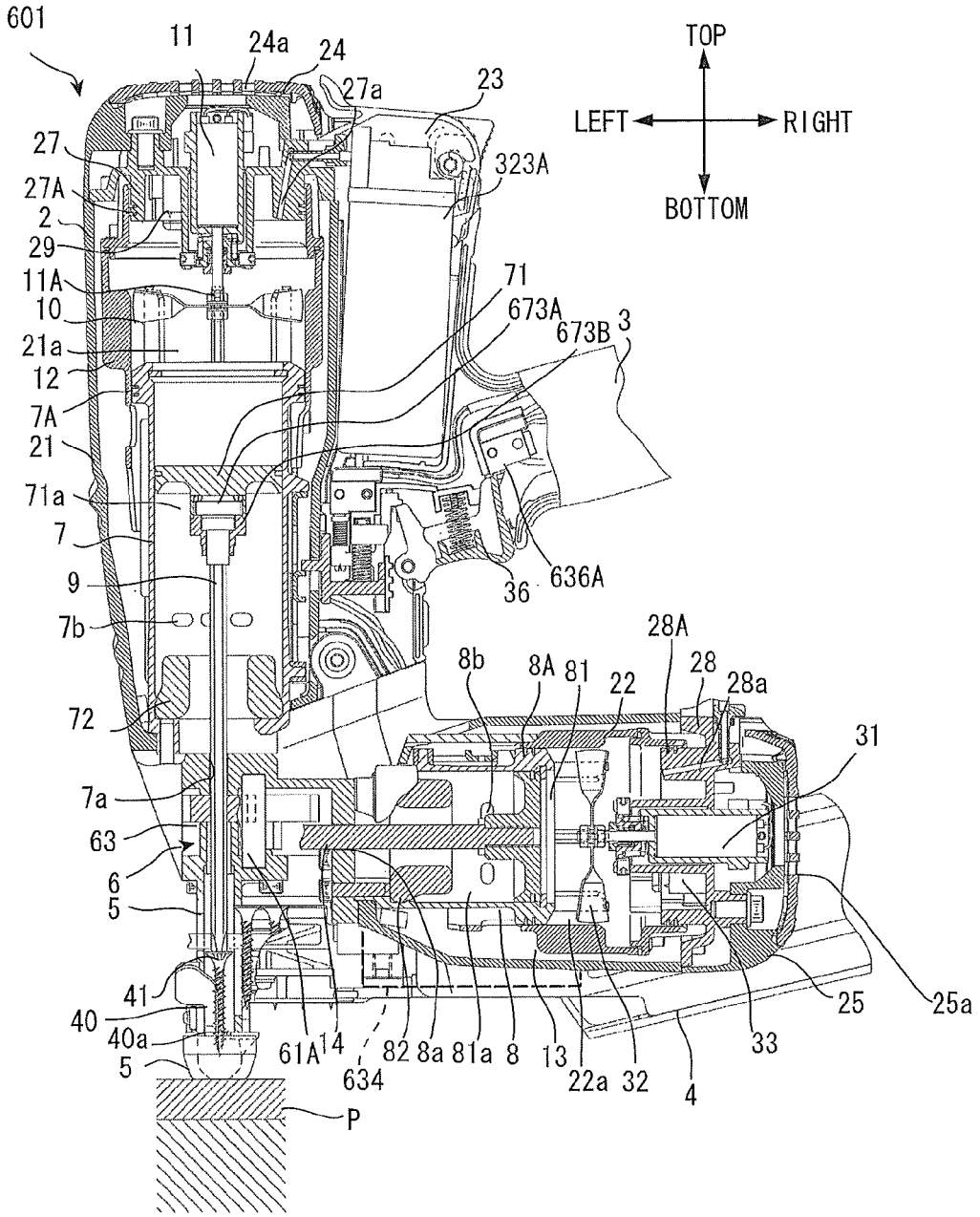
FIG. 15 is a cross-sectional view of the fastener driving tool according to the sixth embodiment at a phase where rotation of a bit is about to be started.
Figure 17:
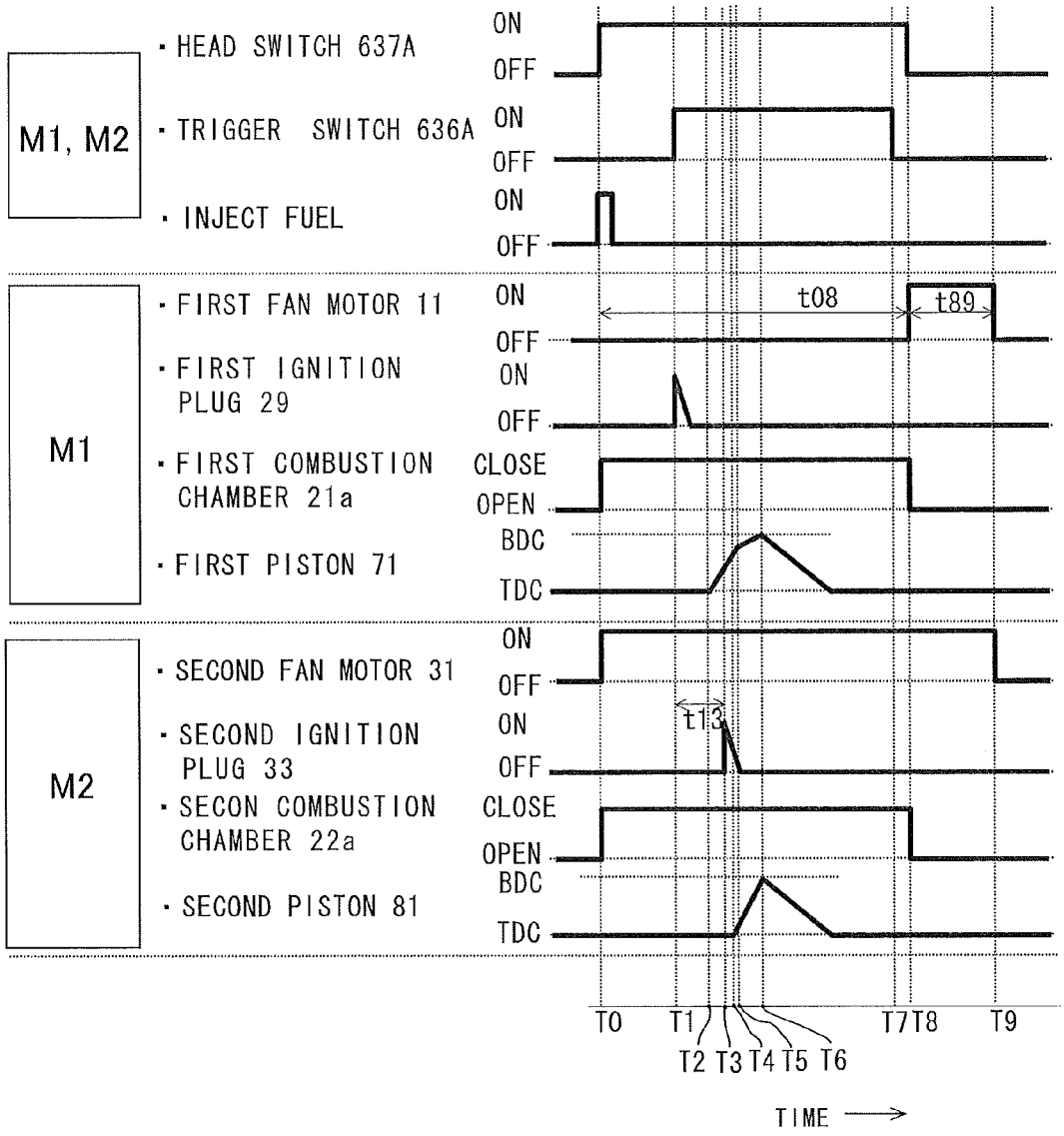
FIG. 17 is a time chart illustrating operation timing and period of respective components in the fastener driving tool according to the sixth embodiment.

At a timing T=T0 shown in FIG. 17, when the fasten driving tool 601 is pressed against the workpiece P as shown in FIG. 15, the push lever 5 is moved upward relative to the nose portion 40, whereupon the first combustion chamber 12 is moved upward relative to the first cylinder 7 to close the first combustion chamber 21*a*, and the head switch 637A (FIG. 14) is rendered ON. Concurrently with the movement of the first combustion chamber frame 12, the second combustion chamber frame 13 is moved rightward relative to the second cylinder 8 through the second link member (not shown) to close the second combustion chamber 22*a*. Upon turning ON the head switch 637A, the signal is transmitted from the head switch 637A to the second fan driver circuit 639A to turn ON the second fan motor 31 thereby rotating the second fan 32 at a rotation speed of about 12000 $min^{-1}$.

In accordance with the movement of the push lever 5, a fuel (combustible gas) is injected into the first fuel passage 27*a* and the second fuel passage 28*a* from the gas canister 323A, to introduce the fuel into the closed first combustion chamber 21*a* and the closed second combustion chamber 22*a*. Since the second fan 32 in the second combustion chamber 22*a* has been rotating, the introduced fuel is agitated and mixed with air (oxygen) to provide an air/fuel mixture. On the other hand, since the first fan 10 has not been rotated, sufficient air/fuel mixture cannot be provided in the first combustion chamber 21*a*.

At a timing T=T1, when the trigger 36 is pulled to turn ON the trigger switch 636A, the first ignition driver circuit 638C transmits a signal to the first ignition plug 29 because the head switch 637A has also been turned ON. Therefore, a spark is generated in the first combustion chamber 21*a*, so that combustion of insufficient air/fuel mixture is started. At a time T=T2, movement of the first piston 71 from its top dead center toward the bottom dead center is started.

Further, the ignition timer 639D is operated upon outputting a signal from the first ignition driver circuit 638C. Therefore, the second ignition driver circuit 639C receives signals from both the trigger switch 636A and the head switch 637A and the signal from the ignition timer 639D at a timing T=T3 after elapsing predetermined period of t13 from the timing T1. Thus, the second ignition driver circuit 639C outputs a signal to the second ignition plug 33 to generate a spark in the second combustion chamber 22*a*, so that combustion of air/fuel mixture in the second combustion chamber 22*a* is started. At a timing T=T4, the movement of the second piston 81 from its top dead center toward the bottom dead center is started.

Figure 16:
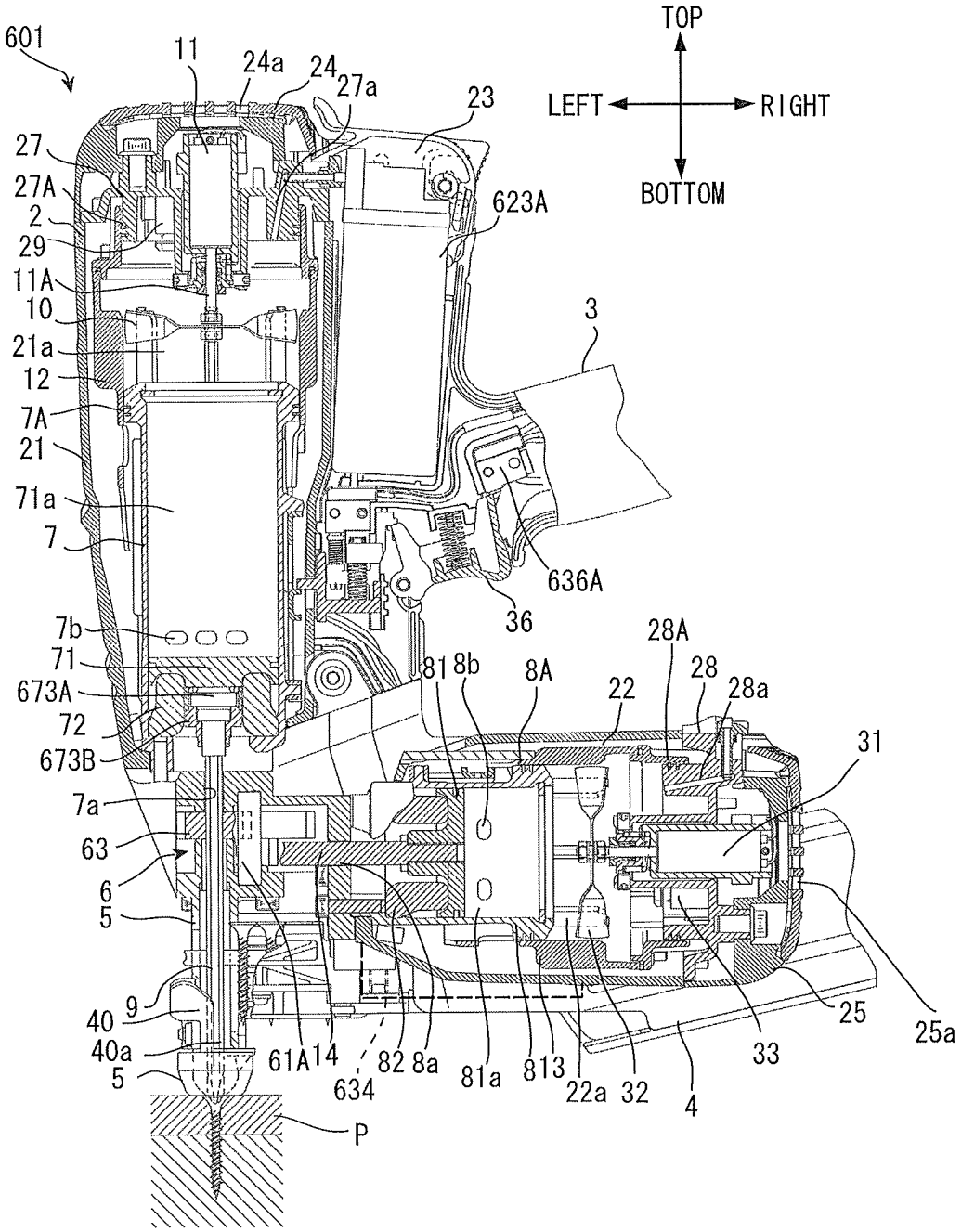
FIG. 16 is a cross-sectional view of the fastener driving tool according to the sixth embodiment at a phase where the fastener has been fully driven into a workpiece.

Thereafter, at a timing T=T5, the screw 41 is brought into contact with the workpiece P by the bit 9 as shown in FIG. 15, and at a timing T=T6, the first and second pistons 71 and 81 reach to their bottom dead centers approximately concurrently as shown in FIG. 16.

Figure 18A:
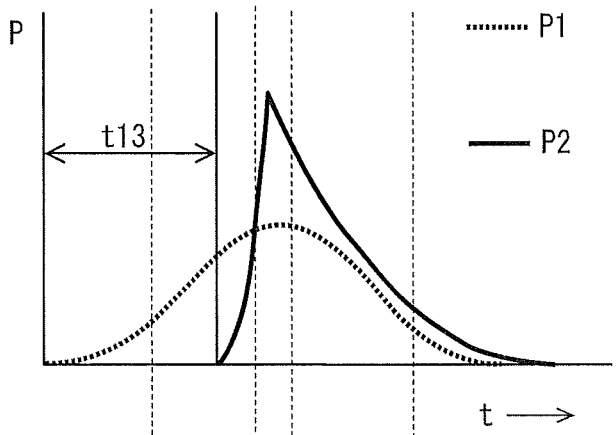
FIG. 18(*a*) is a graph showing a change in pressure P in a first combustion chamber (P1) and a second combustion chamber (P2) relative to a time t in the fastener driving tool according to the sixth embodiment.
Figure 18B:
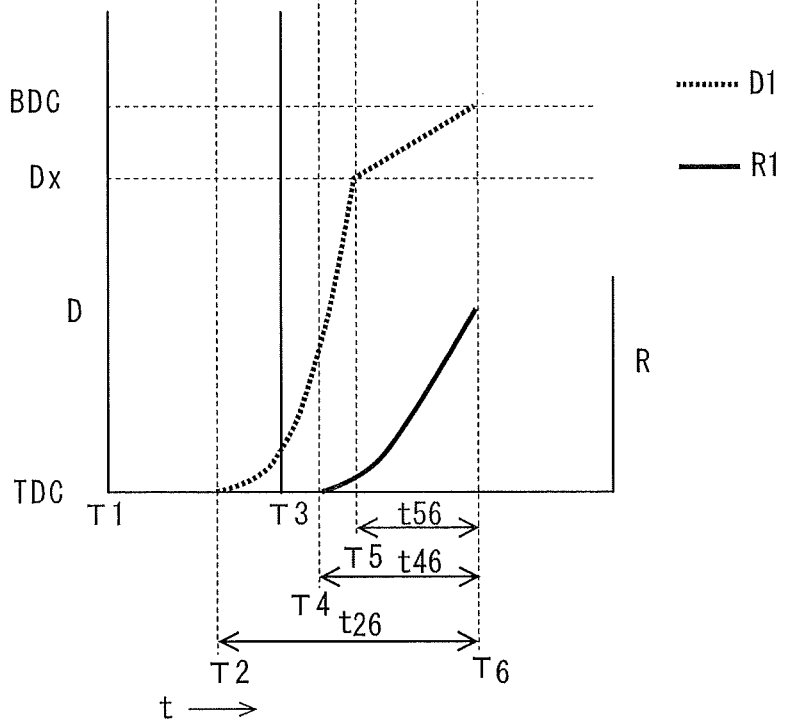

In FIG. 18(*a*), axis of ordinate represents pressure P, and axis of abscissas represents time t. Further, dotted line curve P1 represents pressure in the first combustion chamber 21*a*, and a solid line P2 represents pressure in the second combustion chamber 22*a*. Further, in FIG. 18(*b*), axis of ordinate represents displacement D of the bit 9, i.e., displacement of the first piston 71 in connection with the dotted line D1, and also represents rotation amount R of the bit 9, i.e., displacement of the second piston 81 in connection with the solid line R1, and axis of abscissas represents time t. Further, Dx represents a contact timing of the screw 41 with the workpiece P. Combustion in the first combustion chamber 21*a* starting at the timing T=T1 is performed at a low speed due to insufficient mixture of fuel with air. Therefore, immediate increase in volumetric expansion does not occur. Thus, as shown by the dotted line curve P1 in FIG. 18(*a*), immediate increase in combustion pressure does not occur but a gradual or moderate pressure increase occurs from the timing T1, and a maximum combustion pressure is not become excessive as shown by a dotted curve in FIG. 18(*a*). Accordingly, as shown in FIG. 18(*b*), a prolonged time period (t26: about 20 ms) is required for moving the bit 9 from its top dead center to the bottom dead center.

On the other hand, combustion occurring in the second combustion chamber 22*a* from the timing T3 is a sufficient combustion because of the formation of sufficient air/fuel mixture. Therefore, high combustion speed results to generate prompt volumetric expansion. Accordingly, as shown by solid line P2 in FIG. 18(*a*), immediate increase in combustion pressure P2 occurs and a maximum combustion pressure is greater than that of the combustion pressure P1 in the first combustion chamber 21*a*. Consequently, displacement speed of the second piston 81 from its top dead center to the bottom dead center is faster than that of the first piston 71 from its top dead center to the bottom dead center. According to FIG. 18(*b*), time period t46 (about 10 ms) is required for moving the second piston 81 from its top dead center to the bottom dead center. The first piston 71 and the second piston 81 reach their bottom dead centers at the same timing even if the timing T4 for starting movement of the second piston toward its bottom dead center is later than the timing T2 for starting movement of the first piston toward its bottom dead center. Incidentally, ignition timing of the second ignition plug 33 can be changed by changing a setting of the ignition timer 639D. Therefore, concurrent arrival of the first and second pistons 71 and 81 to their bottom dead centers can be easily attained by experimentally obtaining optimum ignition timing of the second ignition plug 33.

Generally, the screw is threadingly advanced into the workpiece P by rotating the screw 41 about its axis, and therefore, linear pressing force of the bit 9 against the screw 41 can be small as long as the bit 9 can maintain engagement with a cruciform groove formed on a head of the screw. Accordingly, the bit 9 can be sufficiently abutted against the screw 41 even if the maximum combustion pressure in the first combustion chamber 21*a* is small.

Further, the screw 41 must be moved to the position in abutment with the workpiece P prior to the rotation of the screw. As described above, ignition timings of the first and second ignition plugs 29, 33 are different from each other, so that first piston 71 is moved prior to the rotation of the bit 9. Therefore, the screw 41 urged by the bit 9 is brought into contact with the workpiece P at the timing 15 at which increase in rotation number of the bit 9 begins at the initial moving phase of the second piston 81.

After the screw 41 is contacted with the workpiece P, the screw 41 is rotated to be threadingly advanced into the workpiece P. The screw 41 is advanced in its axial direction during threading motion, which requires relatively longer time period, due to inertial resistance of gears in the motion conversion mechanism 6, in comparison with a case where a nail is linearly driven into the workpiece by the linear movement of the piston. To solve this problem, in this embodiment, high combustion pressure in the second combustion chamber 22*a* is provided to accelerate the moving speed of the second piston 81 (rotation speed of the bit 9), while low combustion pressure in the first combustion chamber 21*a* is provided to lower the moving speed of the first piston 71 (linear moving speed of the bit 9). With this arrangement, urging period of the bit 9 against the screw 41 can be prolonged after the screw 41 is brought into contact with the workpiece P. Consequently, the bit 9 can continuously linearly urge the screw 41 until the rotation of the bit 9 is terminated (until the second piston 81 is moved to the bottom dead center).

After the first piston 71 abuts against the bumper 72 (that is, after the threading motion of the screw 41 is terminated), the combustion gas is released to an outside of the first cylinder chamber 71*a* through the vent hole 7*b*, and therefore, pressure in the first cylinder chamber 71*a* and the first combustion chamber 21*a* will gradually lowered. When the pressure become an atmospheric pressure, the check valve (not shown) provided at the vent hole 7*b* is closed. Similarly, in the second combustion chamber 22*a*, the combustion gas is discharged out of the second cylinder chamber 81*a* through the vent hole 8*b*, and the check valve (not shown) on the vent hole 8*b* will be closed when the pressure in the second cylinder chamber 81*a* and the second combustion chamber 22*a* becomes the atmospheric pressure.

The combustion gas remaining in the first cylinder chamber 71*a*, the first combustion chamber 21*a*, the second cylinder chamber 81*a*, and the second combustion chamber 22*a* has high temperature, and therefore, the combustion heat will be absorbed thereinto. Thus, temperature of the first and second cylinders 7, 8 and first and second combustion chamber frames 12, 13 will be increased. The heat is then released to the atmosphere through the outer surfaces thereof.

Because of the heat absorption into the cylinders, combustion gas is promptly cooled to decrease a volume thereof. Accordingly, pressure in the upper chamber of the first piston 71 will be decreased to become a pressure not more than the atmospheric pressure to cause a thermal vacuum. As a result, the first piston 71 can be returned to its initial top dead center position. The same is true with respect to the second combustion chamber 22*a*, so that the second piston 81 is returned to its top dead center position because of the thermal vacuum.

Then the trigger switch 636A is rendered OFF at a timing T7 by releasing the trigger 36, and the user lift the fastener driving tool 601 in its entirety to separate the push lever 5 from the surface of the workpiece P at a timing T8. As a result, the first and second combustion chamber frames 12, 13 are returned to their positions shown in FIG. 13 because of the biasing force of the spring (not shown). Because of the returning motion of the first combustion chamber frame 12, the head switch 637A is turned OFF. Upon turning OFF the head switch 637A and the trigger switch 636A, the first fan timer 638B is operated by a predetermined time period (t89: about 10 s) to output signal, and further the second fan timer 639B continues to transmit signal so that the rotation of the second fan can continue to the timing T9.

Upon receipt of the signals from the first and second fan timers 638B, 639B at the first and second fan driver circuits 638A, 639A, respectively, the first and second fans 10 and 32 continue rotation for a predetermined period at the above-described rotation speed (about 12000 $min^{-1}$) to generate air flow. That is, fresh air is introduced from the air intake ports 24*a*, 25*a* of the first and second head covers 24, 25 into first and second combustion chambers 21*a*, 22*a* through the first vent hole 21*b* and the third vent hole 22*b*, and the air and the residual combustion gas can be discharged through the exhaust port (not shown) of the housing 2. Then, at the timing T9, rotation of the first and second fans 10 and 32 are stopped to restore an original stationary phase. Then, the above-described operation will be repeatedly performed for successively driving the screws 41 into the workpiece P.

A fastener driving tool according to a seventh embodiment of the present invention will be described with reference to FIGS. 19 and 20. The seventh embodiment is the same as the sixth embodiment except for a control device 734.

Figure 19:
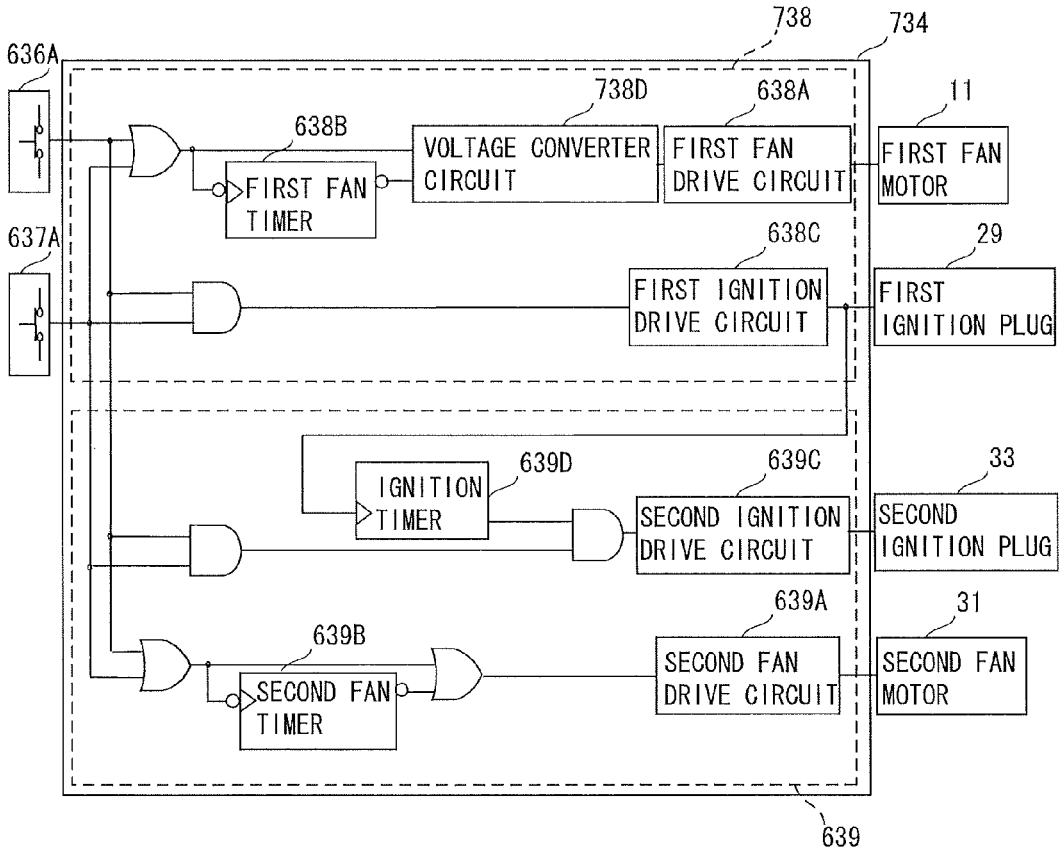
FIG. 19 is a block diagram showing a control device in a fastener driving tool according to a seventh embodiment of the present invention; and, FIG. 20 is a time chart illustrating operation timing and period of respective components in the fastener driving tool according to the seventh embodiment.

The control device 734 is connected to the trigger switch 636A, the head switch 637A, the first ignition plug 29, the second ignition plug 33, the first fan 10, and the second fan 32 as shown in FIG. 19. The control device 734 includes a linear driving controller 738 for controlling movement of the first piston 71, and the rotational driving controller 639 for controlling movement of the second piston 81.

The linear driving controller 738 includes the first fan driver circuit 638A, the first fan timer 638B, the first ignition driver circuit 638C, and a voltage converter circuit 738D. The rotational driving controller 639 is the same as that of the sixth embodiment.

The first fan driver circuit 638A is connected to the first fan motor 11 for selectively applying a voltage for rotating the first fan motor 11 at a low speed (about 600 $min^{-1}$) or another voltage for rotating the first fan motor 11 at a high speed (about 12000 $min^{-1}$) to the first fan motor 11 in response to a signal from the voltage converter circuit 738D. A signal from the head switch 637A and a signal from the trigger switch 636A are to be applied to the first fan timer 638B. The first fan timer 638B is configured to continue transmission of a drive signal to the voltage converter circuit 738D for a predetermined period of time in response to a timing where no signals from the head switch 637A and the trigger switch 636A are transmitted to the first fan timer 638B. The first ignition driver circuit 638C is configured to output a drive signal to the first ignition plug 29 upon reception of signals from both the head switch 637A and the trigger switch 636A. The voltage converter circuit 738D is configured to output a first voltage to the first fan driver circuit 638A in response to a signal from at least one of the head switch 637A and the trigger switch 636A, and output a second voltage to the first fan driver circuit 638A in response to a signal from the first fan timer 638B. Here, the first voltage is a low-voltage signal indicative of low rotation speed of the first fan motor 11, and the second voltage is a high-voltage signal indicative of high rotation speed thereof.

A screw driving process with the control device 734 will be described with reference to a block diagram shown in FIG. 19 and a timing chart shown in FIG. 20. Each operation at each timing (from T0 to T9) is approximately the same as that of the sixth embodiment. Therefore, description is given to operation different from that of the sixth embodiment.

Figure 20:
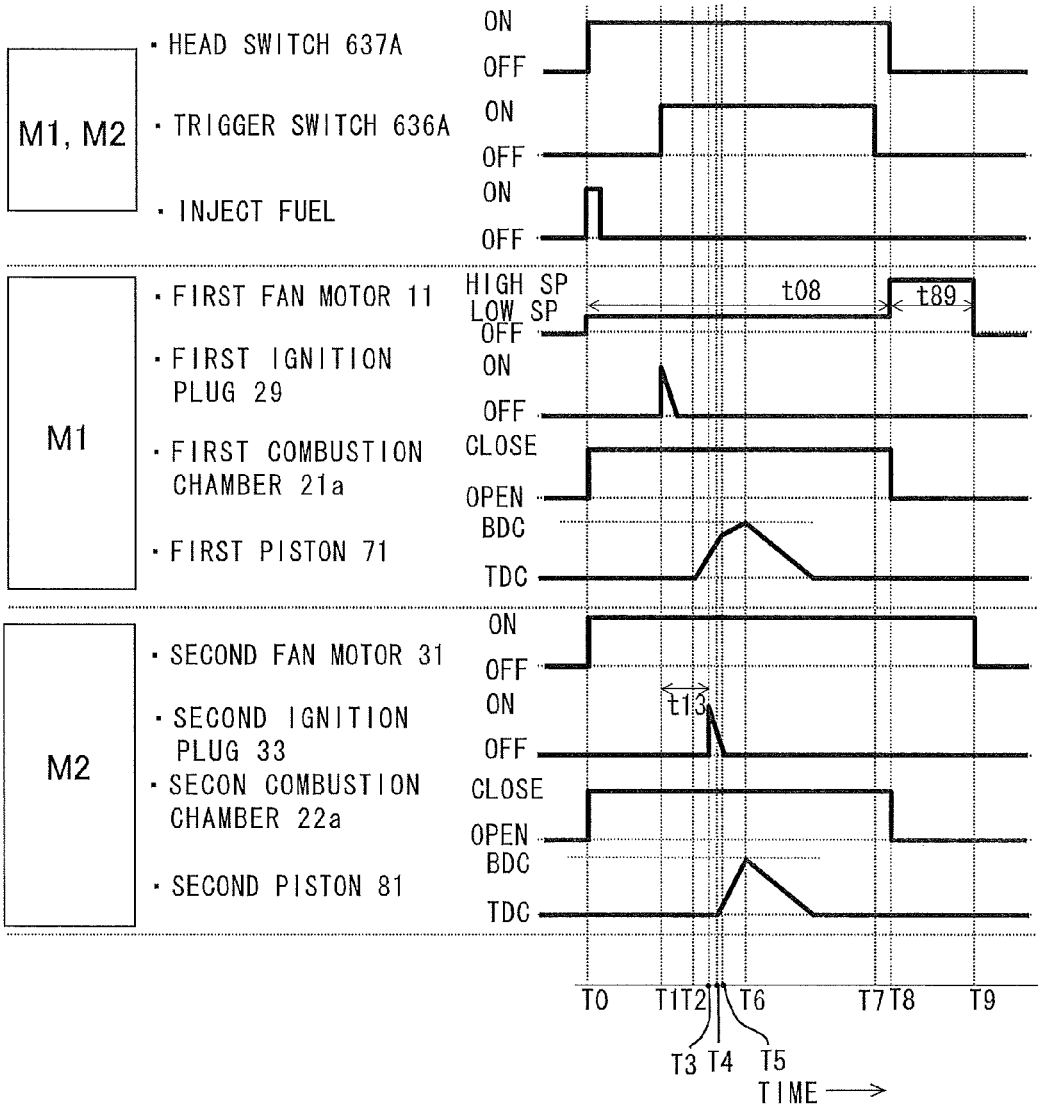

As shown in FIG. 20, at a timing T=T0, fuel is injected in to the first and second combustion chambers 21*a*, 22*a*, and the head switch 637A is turned ON. Therefore, the head switch 637A transmits the signal to the second fan driver circuit 639A to turn ON the second fan motor 31. As a result, the second fan 32 rotates at abut 12000 $min^{-1}$. At the same time, the head switch 637A transmits the signal to the voltage converter circuit 738D, so that the voltage converter circuit 738D outputs the first voltage for rotating the first fan motor 11 at the low speed. By the rotation of the second fan motor 31, a sufficient air/fuel mixture can be formed in the second combustion chamber 22*a*, whereas a sufficient air/fuel mixture cannot be formed in the first combustion chamber 21*a* due to low rotation speed of the first fan motor 11.

Then, at a timing T1, the trigger 36 is pulled to turn ON the trigger switch 636A. At this timing, both the trigger switch 636A and the head switch 637A transmit signals, so that the first ignition driver circuit 638C transmits the signal to the first ignition plug 29 in response to the two signals. Thus, a spark is generated at the first ignition plug 29 in the first combustion chamber 21*a*. As a result, combustion in the first combustion chamber 21*a* is started, and the first piston 71 starts to move from its top dead center toward the bottom dead center at the timing T2.

Combustion speed in the first combustion chamber 21*a* from the timing T1 is low due to insufficient air/fuel mixture similar to the sixth embodiment. Therefore, prolonged time period is required for the movement of the bit 9 from its top dead center to its bottom dead center, and particularly, a period from the contacting timing of the screw 41 onto the workpiece P to the timing at which the bit 9 reaches the bottom dead center. Accordingly, time period for urging the bit 9 against the screw 41 can be prolonged.

At the timing T8 where the trigger switch 636A and the head switch 637A are turned OFF, the voltage converter circuit 738D only receives the signal from the first fan timer 638B. Therefore, the voltage converter circuit 738D transmits second voltage to the first fan driver circuit 638A to rotate the first fan motor 11 at high speed. Therefore, in the duration from the timing T8 to T9 (t89), gas exhaust and air intake operation can be sufficiently performed for the next fastener driving operation.

In the sixth embodiment, the first fan 10 is not rotated during the period from T0 to T8 (t08), but is rotated during the period from T8 to T9 (t89). In this case, combustion speed in the first combustion chamber 21*a* is low due to insufficient mixture of the combustible gas with the air. Therefore, during the period from T8 to T9 (t89), a part of the combustible gas may be exhausted as uncombusted fuel. On the other hand, according to the seventh embodiment, since the first fan 10 is rotating at the low speed (about 600 $min^{-1}$) in the period from T0 to T8 (t08), the combustible gas can be mixed with air to some extent. Therefore, combustion performance in the seventh embodiment is greater than that of the sixth embodiment to lower generation of uncombusted fuel.

While the invention has been described in detail and with reference to specific embodiments thereof, it would be apparent to those skilled in the art that various changes and modifications may be made therein without departing from the spirit and scope of the invention.

The third through fifth embodiments pertain to the combustion type fastener driving tool in which the pistons are driven by pressure increase in combustion gas. However, the above described embodiments can be available for a pneumatically operated fastener driving tool where pistons are driven by compressed air pressure.

In the seventh embodiment, low rotation speed period of the first fan 10 is not limited to from T0 to T8, but can be set in a period from T1 to T8 (starting from the ignition timing of the first ignition plug 29 and ending at a timing immediately prior to exhaust and suction). Alternatively, the low rotation speed period can be set to a period from T0 to T1 (from the fuel injection timing to the ignition timing of the first ignition plug 29).

Incidentally, the periods of high rotation speed (12000 $min^{-1}$) and the low rotation speed (600 $min^{-1}$) are not limited to the seventh embodiments. Duration and speed can be changed in accordance with a configuration of the tool, and kind of fasteners.

INDUSTRIAL APPLICABILITY

The fastener driving tool according to the present invention is particularly available for the tool requiring intensive linear driving force and rotational fastening force, while a hose for supplying compressed air or a cord for supplying an electric power is not required.

REFERENCE SINGS LIST

1, 201,301,401,501,601,701: fastener driving tool
2, 202: housing
4: magazine
5: push lever
6, 206: motion conversion mechanism
7: first cylinder
8: second cylinder
207: cylinder
207*a*: first cylinder chamber
9, 209: bit
10: first fan
12: first combustion chamber frame
13: second combustion chamber frame
212: combustion chamber frame
14, 214: rod
14A,214A,314A: rack
17: second link member
21: first housing
21*a*: first combustion chamber
214*a*: notched portion
22*a*: second combustion chamber
221*a*: combustion chamber
22: second housing
27: first cylinder head
28: second cylinder head
29: first ignition plug
33: second ignition plug
334: control device
375: solenoid
476: stop member
476A: first arm
476B: second arm
476C: pivot shaft portion
477: spring
507*a*: fluid passage
581A: partition wall
634, 734: control device
71, 271: first piston
81, 281: second piston

The invention claimed is:

1. A fastener driving tool comprising:

a housing;

a cylinder including a first cylinder fixed to the housing and a second cylinder fixed to the housing;

a combustion chamber frame movable in the housing and defining a combustion chamber in cooperation with the cylinder;

a first piston slidably reciprocally movable relative to the first cylinder and displaced upon expansion of air/fuel mixture in the combustion chamber;

a second piston slidably reciprocally movable relative to the second cylinder and displaced upon expansion of air/fuel mixture in the combustion chamber;

a bit extending from the first piston and having a base end portion supported to the first piston and rotatable about its axis, and having a free end portion engageable with a fastener, the bit being linearly movable in accordance with the movement of the first piston;

a rod extending from the second piston and having a rack, the rod being linearly movable in accordance with the movement of the second piston; and a motion conversion mechanism having a first part engageable with the rack, and a second part engaged with the bit for converting the linear movement of the rod into a rotational movement of the bit.

2. The fastener driving tool as claimed in claim 1, further comprising:

a magazine connected to the housing for accommodating the fastener and for guiding movement of the fastener to a fastening position; and a push lever movable relative to the housing upon depression to a workpiece, and wherein the combustion chamber frame is movable in the housing in accordance with the movement of the push lever, and wherein the first piston selectively provides the combustion chamber in accordance with the movement of the combustion chamber frame, and wherein the second piston selectively provides a combustion chamber in accordance with the movement of the combustion chamber frame, and wherein the free end portion of the bit is engagable with the fastener positioned at the fastening position.

3. The fastener driving tool as claimed in claim 2, wherein the rack is configured to be positioned on the rod so that a start timing of the engagement between the rack and the first part is later than a start timing of the linear movement of the bit, whereby the rotation of the bit is started after elapse of a predetermined time period during which the bit linearly drives the fastener into the workpiece by a predetermined depth.

4. The fastener driving tool as claimed in claim 2, wherein the housing comprises a first housing, and a second housing connected thereto; and wherein the combustion chamber frame comprises a first combustion chamber frame disposed within the first housing, and a second combustion chamber frame disposed within the second housing, and wherein the first cylinder is configured to guide the movement of the first combustion chamber frame, and the second cylinder is configured to guide the movement of the second combustion chamber frame.

5. The fastener driving tool as claimed in claim 4, further comprising a link having one end pivotally movably connected to the push lever and having another end pivotally movably connected to the second combustion chamber frame, the link providing a tilting posture changeable in accordance with the movement of the push lever, the first combustion chamber frame being movable in accordance with a movement of the push lever, and the second combustion chamber frame being movable in accordance with a movement of the push lever through the link.

6. The fastener driving tool as claimed in claim 4, further comprising a first ignition plug disposed in the first housing and providing a first ignition timing; and a second ignition plug disposed in the second housing and providing a second ignition timing later than the first ignition timing such that a start timing for starting engagement of the rack with the first part of the motion converting mechanism occurs after the fastener has been driven into a workpiece by a predetermined amount by the bit.

7. The fastener driving tool as claimed in claim 4, wherein the first cylinder defines a first cylinder chamber and has a first opening, a first combustion chamber being defined in cooperation with a portion of the first cylinder including the first opening, and a fuel being injected into the first combustion chamber; and the fastener driving tool further comprising;

a first cylinder head disposed to confront the first opening and defining the first combustion chamber upon contact with the first combustion chamber frame;

a first fan rotatably provided at the first cylinder head and exposed to the first combustion chamber; and, a drive control device that controls rotation of the first fan such that the first fan rotates at a first rotation speed during gas exhaust and air suction phases in the first combustion chamber, and the first fan rotates at a second rotation speed lower than the first rotation speed or the rotation of the first fan is stopped when the fuel is introduced into the first combustion chamber and the fuel is combusted in the first combustion chamber.

8. The fastener driving tool as claimed in claim 7, wherein the second cylinder defines a second cylinder chamber and has a second opening, a second combustion chamber being defined in cooperation with a portion of the second cylinder including the second opening, and a fuel being injected into the second combustion chamber; and the fastener driving tool further comprising:

a first ignition plug exposed to the first combustion chamber for igniting the fuel in the first combustion chamber; and a second ignition plug exposed to the second combustion chamber for igniting the fuel in the second combustion chamber, the first ignition plug being ignited prior to an ignition of the second ignition plug.

9. The fastener driving tool as claimed in claim 8, further comprises:

a second cylinder head disposed to confront the second opening and defining the second combustion chamber upon contact with the second combustion chamber frame; and, a second fan rotatably provided at the second cylinder head and exposed to the second combustion chamber; and wherein the drive control device further controls rotation of the second fan.

10. The fastener driving tool as claimed in claim 1, wherein the first cylinder and the second cylinder are juxtaposed with each other in a single housing, each of the first cylinder and the second cylinder having one end portion and another end portion.

11. The fastener driving tool as claimed in claim 10, wherein the combustion chamber is a single combustion chamber provided at each one end portion of the first cylinder and the second cylinder; and wherein the first cylinder and the second cylinder are juxtaposed with each other in the single combustion chamber frame such that the first cylinder and the second cylinder are configured in combination to guide a movement of the single combustion chamber frame.

12. The fastener driving tool as claimed in claim 11, wherein the first piston and the second piston are simultaneously movable toward their bottom dead centers; and wherein the rack is so positioned on the rod that a timing for starting engagement of the rack with the first part of the motion converting mechanism occurs after the fastener has been driven into a workpiece by a predetermined amount by the bit.

13. The fastener driving tool as claimed in claim 10, further comprising a retard mechanism that causes a start timing of moving the second piston from one end portion of the second cylinder to the another end portion of the second cylinder to be later than a start timing of moving the first piston from one end portion of the first cylinder to the another end portion of the first cylinder.

14. The fastener driving tool as claimed in claim 13, wherein the combustion chamber is a single combustion chamber provided at each one end portion of the first cylinder and the second cylinder; and wherein the first cylinder defines therein a first cylinder chamber, and the second cylinder defines therein a second cylinder chamber, the first cylinder chamber and the second cylinder chamber being in communication with the single combustion chamber.

15. The fastener driving tool as claimed in claim 13, wherein the first cylinder defines an axial direction; and wherein the rod has an engagement portion providing a locus in accordance with the movement of the second piston (281) between the one end portion and the another end portion of the second cylinder; and wherein the retard mechanism comprises an actuator movable in a direction crossing the axial direction, between a protruding position and a retracting position, at the protruding position the actuator being engaged with the engagement portion to prevent the rod from moving from the one end portion toward the another end portion of the second cylinder during an initial moving phase of the first piston from the one end portion toward the another end portion of the first cylinder, and at the retracting position the actuator being retracted from the locus to permit the rod from moving past the actuator from the one end portion toward the another end portion of the second cylinder at a timing later than a timing of starting the movement of the first piston toward the another end portion of the first cylinder.

16. The fastener driving tool as claimed in claim 13, wherein the first cylinder defines therein a first cylinder chamber, and also defines an axial direction; and wherein the rod has an engagement portion providing a locus in accordance with the movement of the second piston between the one end portion and the another end portion of the second cylinder; and wherein the retard mechanism comprises a stop member and a biasing member;

the stop member being movable between a protruding position and a retracting position and having a pivot shaft portion pivotally movably supported to the cylinder and extending in a direction perpendicular to the axial direction; a first arm extending from the pivot shaft portion and movable between the protruding position protrudable into the first cylinder chamber and the retracting position retractable therefrom; and a second arm extending from the pivot shaft portion and movable between the protruding position engageable with the engagement portion at the protruding position of the first arm and the retracting position retracting from the locus at the retracting position of the first arm, the first piston being abuttable against the first arm while the first arm is at the protruding position when the first piston is moved from the one end portion to the another end portion of the first cylinder to move the first arm and the second arm to the retracting position; and the biasing member being interposed between the cylinder and the stop member and biasing the stop member toward the protruding position.

17. The fastener driving tool as claimed in claim 13, wherein the first cylinder and the second cylinder define therein a first cylinder chamber, and a second cylinder chamber, respectively; and wherein the retard mechanism comprises a fluid passage section having a first opening open to the first cylinder chamber and a second opening open to the second cylinder chamber for providing a fluid communication between the first cylinder chamber and the second cylinder chamber, the first opening being positioned such that the first piston shuts off fluid communication between the combustion chamber and the first opening when the first piston is positioned at the one end portion of the first cylinder, and the first piston firstly allows the first opening to communicate with the combustion chamber when the first piston is moved toward the another end portion of the first cylinder by a predetermined distance, the second cylinder chamber being commuicatable with the combustion chamber through only the fluid passage section.

18. The fastener driving tool as claimed in claim 17, wherein the retard mechanism further comprises a partition wall partitioning an upper space of the second cylinder chamber above the second piston from the combustion chamber to prevent the second piston from moving toward the another end portion of the second cylinder during initial combustion state in the combustion chamber.

* * * * *